US009256167B2

(12) United States Patent
Nagata et al.

(10) Patent No.: US 9,256,167 B2
(45) Date of Patent: Feb. 9, 2016

(54) IMAGE FORMING APPARATUS

(71) Applicants: Atsushi Nagata, Kanagawa (JP); Kenji Sugiura, Kanagawa (JP); Naohiro Kumagai, Kanagawa (JP); Seiichi Kogure, Kanagawa (JP); Junpei Fujita, Kanagawa (JP); Yuuji Wada, Kanagawa (JP); Yusuke Mitani, Kanagawa (JP); Kazuki Yogosawa, Tokyo (JP)

(72) Inventors: Atsushi Nagata, Kanagawa (JP); Kenji Sugiura, Kanagawa (JP); Naohiro Kumagai, Kanagawa (JP); Seiichi Kogure, Kanagawa (JP); Junpei Fujita, Kanagawa (JP); Yuuji Wada, Kanagawa (JP); Yusuke Mitani, Kanagawa (JP); Kazuki Yogosawa, Tokyo (JP)

(73) Assignee: RICOH COMPANY, LIMITED, Tokyo (JP)

( * ) Notice: Subject to any disclaimer, the term of this patent is extended or adjusted under 35 U.S.C. 154(b) by 0 days.

(21) Appl. No.: 14/449,270

(22) Filed: Aug. 1, 2014

(65) Prior Publication Data

US 2015/0037054 A1 Feb. 5, 2015

(30) Foreign Application Priority Data

Aug. 2, 2013 (JP) ..... 2013-161379
Jan. 10, 2014 (JP) ..... 2014-003127

(51) Int. Cl.
*G03G 15/16* (2006.01)

(52) U.S. Cl.
CPC ..... *G03G 15/1665* (2013.01)

(58) Field of Classification Search
CPC ..... G03G 15/5058; G03G 2215/00059; G03G 2215/00063
See application file for complete search history.

(56) References Cited

U.S. PATENT DOCUMENTS

| | | | | |
|---|---|---|---|---|
| 7,593,655 | B2 * | 9/2009 | Nishida et al. | 399/49 |
| 2002/0110381 | A1 * | 8/2002 | Maebashi et al. | 399/49 |
| 2005/0201775 | A1 * | 9/2005 | Ikeda | 399/101 |
| 2006/0275570 | A1 * | 12/2006 | Egawa | 428/35.7 |
| 2008/0138094 | A1 * | 6/2008 | Shiori et al. | 399/9 |
| 2009/0180791 | A1 | 7/2009 | Matsushita et al. | |
| 2010/0221025 | A1 * | 9/2010 | Takahashi | 399/49 |

(Continued)

FOREIGN PATENT DOCUMENTS

| | | |
|---|---|---|
| JP | 3172557 | 3/2001 |
| JP | 2004-061602 | 2/2004 |
| JP | 2009-168906 | 7/2009 |

(Continued)

OTHER PUBLICATIONS

U.S. Appl. No. 14/209,330, filed Mar. 13, 2014.

*Primary Examiner* — Gregory H Curran
(74) *Attorney, Agent, or Firm* — Harness, Dickey & Pierce, P.L.C.

(57) ABSTRACT

An image forming apparatus includes an image bearer; a toner image forming unit, a transfer unit, a detector, and a controller. The toner image forming unit forms a plurality of types of density detection patterns on the surface of the image bearer in mutually-different positions in a surface-movement direction of the image bearer. The density detection patterns have mutually-different lengths in a direction orthogonal to the surface-movement direction of the image bearer. The transfer unit transfers the density detection patterns onto the surface of the transfer member. The detector detects image densities of the density detection patterns transferred on the surface of the transfer member. The controller calculates an image density difference between the density detection patterns on a basis of a detection result obtained by the detector, and corrects a transfer bias for transferring a toner image on a basis of a value of the image density difference.

18 Claims, 10 Drawing Sheets

(56) References Cited

U.S. PATENT DOCUMENTS

| | | | | |
|---|---|---|---|---|
| 2011/0222128 | A1 | 9/2011 | Wada | |
| 2012/0230740 | A1 | 9/2012 | Mikami et al. | |
| 2013/0028625 | A1* | 1/2013 | Ando et al. | 399/72 |

FOREIGN PATENT DOCUMENTS

| | | |
|---|---|---|
| JP | 2009-168925 | 7/2009 |
| JP | 2011-209674 | 10/2011 |
| JP | 2012-208485 | 10/2012 |

* cited by examiner

IMAGE FORMING APPARATUS

CROSS-REFERENCE TO RELATED APPLICATIONS

The present application claims priority to and incorporates by reference the entire contents of Japanese Patent Application No. 2013-161379 filed in Japan on Aug. 2, 2013 and Japanese Patent Application No. 2014-003127 filed in Japan on Jan. 10, 2014.

BACKGROUND OF THE INVENTION

1. Field of the Invention

The present invention relates to an image forming apparatus such as a copying machine, a printer, a facsimile, or the like and, more specifically, to a tandem image forming apparatus.

2. Description of the Related Art

In this type of image forming apparatus, a plurality of image bearers are arranged along the direction of a surface movement of a transfer member such as a recording member or an intermediate transfer member. An image is formed by forming toner images on the image bearers by using a developing agent (hereinafter, "developer") provided in a developing device and subsequently transferring the formed toner images onto the transfer member. In the image forming apparatus configured in this manner, the toner images formed on the image bearers are transferred onto the transfer member by applying a transfer bias thereto from a transfer unit. The percentage of the toner (hereinafter, "transfer rate") that is transferred onto the transfer member out of the toner structuring each of the toner images formed on the image bearers changes in relation to an electric charge amount (hereinafter, "charge amount") of the toner and the magnitude of the transfer bias.

While the developer deteriorates over the course of time, the toner charge amount (more specifically, a specific charge (Q/M) expressed as a charge amount per unit mass of the developer) changes. Thus, even if the transfer bias is set to an appropriate value in accordance with the toner charge amount at an initial point in time when the developer had not yet deteriorated, the transfer bias no longer has an appropriate value at a later time when the developer became deteriorated, because the toner charge amount has changed.

An image forming apparatus disclosed in Japanese Patent No. 3,172,557 is configured to count the number of sheets printed, to find out the degree of deterioration of the developer in accordance with the counted result, and to correct the transfer bias so as to obtain an optimal transfer current. When the image forming apparatus disclosed in Japanese Patent No. 3,172,557 is used, even if an overall toner charge amount has decreased due to deterioration of the developer over the course of time, because the transfer bias is corrected in accordance therewith, it is possible to inhibit degradation of image quality caused by the deterioration of the developer over the course of time.

It has been found out, however, that even if the number of sheets printed is the same, the degree of deterioration of a developer varies depending on output conditions of the image forming apparatus. For example, under a condition where a large number of sheets are output with images having a low image area ratio such as diagrams or text images, the developer tends to deteriorate faster than under a condition where a large number of sheets are output with images having a high image area ratio such as solid images, even if the numbers of sheets printed are the same. It is considered that the reason is that, when the large number of sheets are output with the images having a low image area ratio, because the consumption amount of the developer in the developing device is smaller, a larger amount of developer stays inside the developing device, so that a larger stress is applied to the developer, and the deterioration of the developer thus progresses faster.

Accordingly, when the transfer bias is corrected by finding out the degree of deterioration of the developer simply on the basis of only the number of image formed sheets, it is difficult to set the transfer bias to an appropriate value because the degree of deterioration of the developer varies depending on the output conditions that have so far been used by the image forming apparatus.

Thus, there is a need for an image forming apparatus capable of finding out the degree of deterioration of the developer more appropriately and setting the transfer bias to an appropriate value.

SUMMARY OF THE INVENTION

According to an embodiment, an image forming apparatus includes an image bearer whose surface moves; a toner image forming unit that forms a toner image on the surface of the image bearer by using a developer; a transfer unit that transfers the toner image formed on the surface of the image bearer onto a surface of a transfer member by applying a transfer bias thereto; a detector that detects an image density of the toner image formed on the surface of the transfer member; and a controller that controls the transfer bias. The toner image forming unit forms a plurality of types of density detection patterns on the surface of the image bearer in mutually-different positions in a surface-movement direction of the image bearer. The plurality of types of density detection patterns has mutually-different lengths in a direction orthogonal to the surface-movement direction of the image bearer. The transfer unit transfers the plurality of types of density detection patterns onto the surface of the transfer member. The detector detects image densities of the plurality of types of density detection patterns transferred on the surface of the transfer member. The controller calculates an image density difference between the plurality of types of density detection patterns on a basis of a detection result obtained by the detector, and corrects the transfer bias on a basis of a value of the image density difference.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

First Embodiment

The following will describe a first embodiment in which an image forming apparatus of the present invention is applied to an electrophotography-type copying machine realized with a tandem image forming apparatus that implements an intermediate transfer method, with reference to the accompanying drawings.

Figure 1:
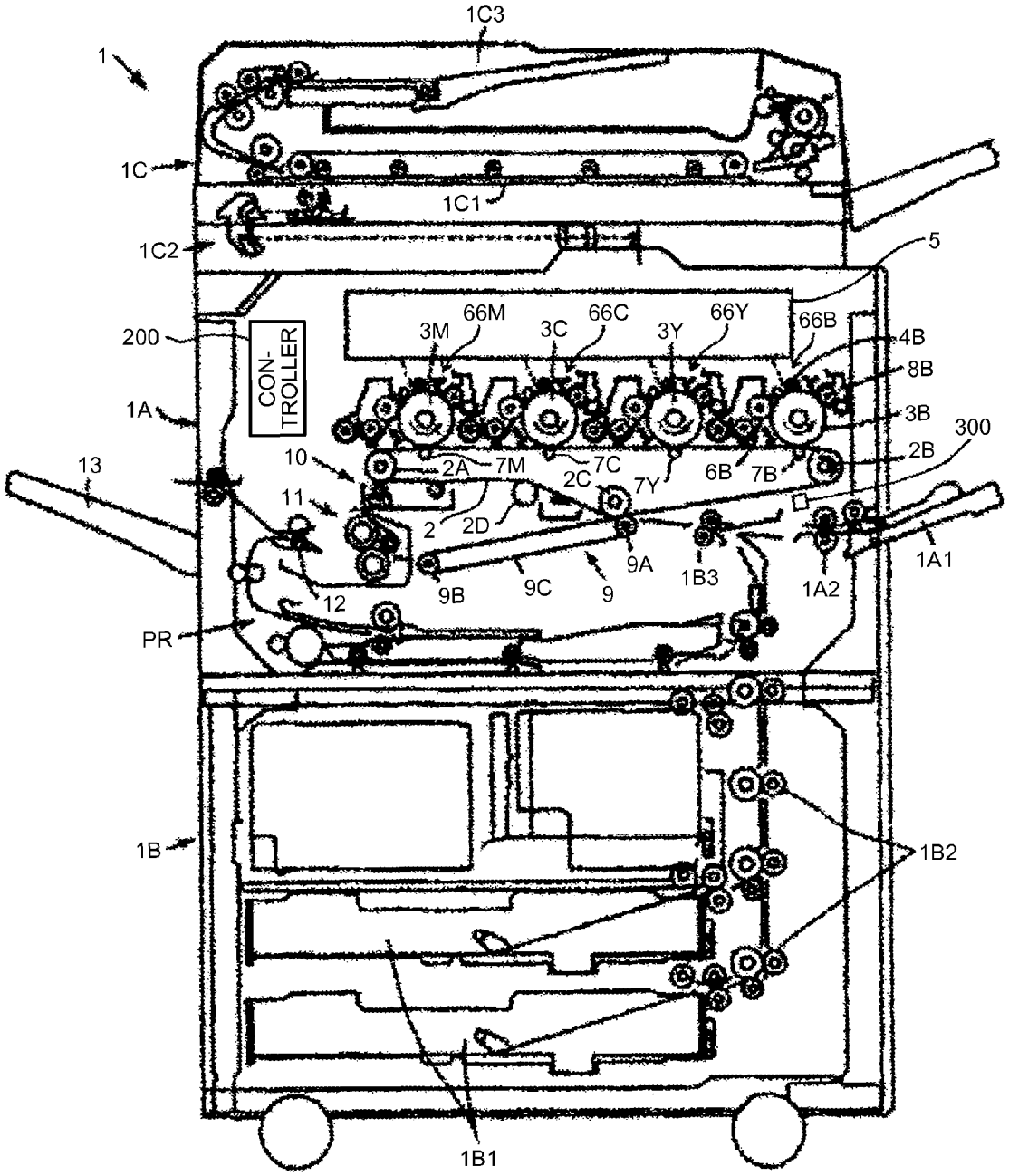
FIG. 1 is a schematic diagram of an overall configuration of a copying machine according to a first embodiment.

FIG. 1 is a schematic diagram of an overall configuration of a copying machine 1 according to the first embodiment.

The copying machine 1 has a tandem structure in which a plurality of photoconductors 3 (M, C, Y, and B) are arranged side by side, the photoconductors 3 each being an image bearer serving as a latent image bearer that bears a toner image in a different one of the colors corresponding to a color separation. The toner images formed on the photoconductors 3 (M, C, Y, and B) first undergo a superimposing transfer process (a primary transfer process) so as to be placed on top of one another on an intermediate transfer belt 2 serving as an intermediate transfer member that is a transfer member. The superimposed toner images subsequently undergo a collective transfer process (a secondary transfer process) onto recording paper serving as a recording member. As a result, the copying machine 1 is able to form a multi-color image on the recording paper.

In the copying machine 1 illustrated in FIG. 1, an image forming unit 1A is positioned in a central part in terms of the up-and-down direction. A paper feeding unit 1B is provided underneath the image forming unit 1A. Further, an original document scanning unit 1C including an original document placement table 1C1 is provided above the image forming unit 1A.

In the image forming unit 1A, the intermediate transfer belt 2 having a tension surface extending in the horizontal direction is provided. In the image forming unit 1A, the four photoconductors 3 (M, C, Y, and B) are arranged side by side along the tension surface of the intermediate transfer belt 2, the photoconductors 3 each being configured to bear the toner image using toner in a different one of the colors (yellow, magenta, cyan, and black) that are in a complementary color relationship. In the following explanation, when the description is shared among all the colors, the reference characters (M, C, Y, and B) used for differentiating the colors will be omitted as appropriate.

The photoconductors 3 (M, C, Y, and B) are configured by using drums that are rotatable in mutually the same direction (counterclockwise in FIG. 1). Provided in the surroundings of the photoconductors 3 are charging devices 4, a writing device 5, developing devices 6, a primary transfer device, and cleaning devices 8 which perform an image forming process during the rotation and which together structure image formation units 66. In FIG. 1, for the sake of convenience, these devices are indicated with the reference characters while using the black photoconductor 3B as an example.

The toner images formed on the photoconductors 3 (M, C, Y, and B) are sequentially transferred onto the intermediate transfer belt 2 by the primary transfer device. The intermediate transfer belt 2 is spanned around a plurality of belt stretching rollers (2A to 2D) so as to be driven to rotate. In addition to the two belt stretching rollers (2A, 2B) that structure the tension surface, provided as another belt stretching roller is a secondary transfer opposite roller 2C which is positioned opposite to a secondary transfer device 9 while the intermediate transfer belt 2 is interposed therebetween and to which a bias having the same polarity as that of the toner is applied. Further, provided as yet another belt stretching roller is a tension roller 2D.

Transfer residual toner that remains on the intermediate transfer belt 2 after the secondary transfer process is removed by a belt cleaning device 10. The belt cleaning device 10 includes a cleaning blade, as well as an applying brush in the form of a roller that is rotatable and is configured to apply solid lubricant. The cleaning blade is configured to abut against the intermediate transfer belt 2 and to scrape off the transfer residual toner from the surface thereof. The applying brush is configured, while rotating, to scrape solid lubricant that is pressed against the applying brush by a pressure spring and to apply the scraped lubricant to the intermediate transfer belt 2. As explained here, the belt cleaning device 10 has both the function of a cleaning device that cleans the transfer residual toner remaining on the intermediate transfer belt 2 and the function of a lubricant applying device that applies the lubricant to the surface of the intermediate transfer belt 2.

Although the belt cleaning device 10 according to the first embodiment is described as implementing a blade method, the belt cleaning device 10 may be configured to implement an electrostatic cleaning method. When the belt cleaning device 10 is configured to implement an electrostatic cleaning method, a bias is applied to either a cleaning roller or a cleaning brush, so that the transfer residual toner adhering to the intermediate transfer belt 2 is cleaned by an electrostatic adsorption.

Further, in the first embodiment, an optical sensor 300 is provided as an image density detector for detecting a toner adhesion amount of the toner image borne on the surface of the intermediate transfer belt 2.

The secondary transfer device 9 includes a secondary transfer belt 9C that is spanned around a driving roller 9A and a driven roller 9B. As a result of the driving roller 9A being driven to rotate, the surface of the secondary transfer belt 9C moves in the same direction as that of the intermediate transfer belt 2, at a secondary transfer part where the secondary transfer belt 9C is in contact with the intermediate transfer belt 2. Although the circumstances may vary depending on bias characteristics of the primary transfer device described above, it is also acceptable to provide the driving roller 9A with an electrically charging characteristic so that recording paper is electrostatically adsorbed. During the process of the recording paper being conveyed by the secondary transfer belt 9C, the secondary transfer device 9 transfers either the superimposed toner image or a monochrome toner image formed on the intermediate transfer belt 2 onto the recording paper.

The recording paper is fed to the secondary transfer part from the paper feeding unit 1B. The paper feeding unit 1B includes a plurality of paper feeding cassettes 1B1, a plurality of conveying rollers 1B2 that are arranged on conveyance paths of the recording paper sent out from the paper feeding cassettes 1B1, and registration rollers 1B3 that are positioned on the upstream side of the secondary transfer part in terms of the paper conveyance direction. Further, in addition to the conveyance paths for the recording paper sent out from the paper feeding cassettes 1B1, the paper feeding unit 1B has a configuration that makes it possible to feed recording paper that is of a type different from the types of paper stored in the paper feeding cassettes 1B1, to the secondary transfer part. This configuration includes: a manual feed tray 1A1 configured with a part of a wall face of the image forming unit 1A that can be lifted up and dropped down; and forwarding rollers 1A2.

A conveyance path for the recording paper sent out from the manual feed tray 1A1 merges with the conveyance path for the recording paper forwarded from any of the paper feeding cassettes 1B1 to the registration rollers 1B3. Further, regardless of which conveyance path the recording paper is fed from, the registration rollers 1B3 set registration timing therefor.

For the writing device 5, writing light is controlled on the basis of image information that is obtained by scanning an original document placed on the original document placement table 1C1 included in the original document scanning unit 1C or image information that is output from a computer (not shown). Further, electrostatic latent images corresponding to the image information are formed on the photoconductors 3 (M, C, Y, and B).

The original document scanning unit 1C includes a scanner 1C2 that is configured to scan, with exposure, the original document placed on the original document placement table 1C1. Further, an automatic original document feeding device 1C3 is provided on the top face of the original document placement table 1C1. The automatic original document feeding device 1C3 is configured to be able to flip over an original document sent out onto the original document placement table 1C1 so that both surfaces of the original document can be scanned.

The electrostatic latent images formed on the photoconductors 3 (M, C, Y, and B) by the writing device 5 undergo a developing process performed by the developing devices 6 (indicated with the reference character 6B in FIG. 1 for the sake of convenience) and subsequently undergo the primary transfer process to be transferred onto the intermediate transfer belt 2. When the toner images corresponding to the different colors have been transferred onto the intermediate transfer belt 2 in a superimposed manner, the superimposed toner images undergo the collective transfer process (the secondary transfer process) to be transferred onto the recording paper by the secondary transfer device 9.

The recording paper on which the secondary transfer process has been performed undergoes a fixing process performed by a fixing device 11 so that an unfixed image borne on the surface can be fixed. Although the details are not shown, the fixing device 11 has a belt fixing structure that includes a fixing belt heated by a heating roller and a pressure roller that opposes and abuts against the fixing belt. By providing a nip area where the fixing belt and the pressure roller abut against each other, it is possible to enlarge the recording paper heating area, compared to other fixing structures involving different rollers. A conveyance path switching claw 12 positioned at the rear of the fixing device 11 is able to switch the conveyance direction of the recording paper that has passed through the fixing device 11, so that the recording paper is either fed toward a paper ejection tray 13 or flipped over and fed toward the registration rollers 1B3 again.

In the copying machine 1 illustrated in FIG. 1, the primary transfer device serving as a transfer unit employs primary transfer rollers 7 (M, C, Y, and B) to which a transfer bias having the positive polarity is applied. The primary transfer rollers 7 (M, C, Y, and B) are pressed by a predetermined level of pressure and are positioned opposite to the photoconductors 3 while the intermediate transfer belt 2 is interposed therebetween, by a bearing and an elastic body such as a compression spring (not shown).

Further, each of the primary transfer rollers 7 (M, C, Y, and B) is configured so as to rotate in conjunction with the intermediate transfer belt 2, in such a position that is offset by 1 to 2 mm from the position opposite to the center of the corresponding one of the photoconductors 3 (M, C, Y, and B) toward the downstream side in terms of the surface movement direction of the intermediate transfer belt. The purpose of this configuration is to avoid occurrence of a pre-transfer where abnormal images are generated (e.g., images are drifted) because the transfer process is started by the transfer bias before a normal transfer position is reached.

Each of the primary transfer rollers 7 (M, C, Y, and B) is configured by wrapping a rubber material having an electrical characteristic with resistance of a medium level (hereinafter, "medium resistance") around a metal core. In the first embodiment, foam rubber having medium resistance is used, and the volume resistivity thereof is in the range of $10^6$ to $10^{10}$ Ω·cm, and preferably $10^7$ to $10^9$ Ω·cm. However, the material is not limited to foam rubber. Solid rubber having medium resistance may similarly be used.

The secondary transfer opposite roller 2C included in the secondary transfer unit of the first embodiment is configured by wrapping a rubber material having an electrical characteristic with medium resistance around a metal core. In the first embodiment, solid rubber having medium resistance is used, and the volume resistivity thereof is in the range of $10^6$ to $10^{10}$ Ω·cm, and preferably $10^7$ to $10^9$ Ω·cm.

Further, the driving roller 9A that functions as a secondary transfer roller is configured with foam rubber having medium resistance, and the volume resistivity thereof is in the range of $10^6$ to $10^{10}$ Ω·cm, and preferably $10^7$ to $10^9$ Ω·cm.

A primary transfer voltage having the positive polarity is applied to the primary transfer rollers 7 (M, C, Y, and B) by an electric power supply placed under constant current control. The current setting value (the setting value for the primary transfer current) is controlled to be approximately within the range of 10 to 40 μA. By applying the primary transfer voltage to the primary transfer rollers 7 (M, C, Y, and B) in this manner, a primary transfer electric field is formed in a primary transfer part positioned between the photoconductors 3 (M, C, Y, and B) and the intermediate transfer belt 2. The primary transfer electric field is formed in such a direction that the toner (having the negative polarity) on the photoconductors 3 (M, C, Y, and B) is drawn toward the intermediate transfer belt 2 side.

In contrast, a secondary transfer voltage having the negative polarity is applied to the secondary transfer opposite roller 2C by an electric power supply placed under constant current control. The current setting value (the setting value for the secondary transfer current) is controlled to be approximately within the range of −20 to −50 μA. In this configuration where the secondary transfer voltage is applied to the secondary transfer opposite roller 2C, the driving roller 9A is electrically grounded. By being positioned opposite to the driving roller 9A connected to the ground, the secondary transfer part has a secondary transfer electric field formed in such a direction that the toner (having the negative polarity) on the intermediate transfer belt 2 is pushed toward the recording paper side.

The intermediate transfer belt 2 used in the first embodiment is configured with a three-layer belt in which, on a base layer of 50 to 100 μm, an elastic layer of 100 to 500 μm is provided, underneath a surface layer that is further provided. As a specific example, the base layer may be configured by using resin having medium resistance obtained by adjusting the resistance of a material such as polyimide (PI), polyamide-imide (PAI), polycarbonate (PC), ethylene tetrafluoroethylene (ETFE), polyvinylidene fluoride (PVDF), polyphenylenesulfide (PPS), or the like, by performing a carbon dispersion process thereon or adding an ion conductive agent thereto. As a specific example, the elastic layer may be configured so as to include a material obtained by adjusting the resistance of a rubber material such as urethane, nitrile butadiene rubber (NBR), chloroprene rubber (CR), or the like, by similarly performing a carbon dispersion process thereon or adding an ion conductive agent thereto. As a specific example, the surface layer may be configured by applying a coating of fluorine-based rubber or resin (or a hybrid material of these) having a thickness of approximately 1 to 10 μm to the surface of the elastic layer.

The intermediate transfer belt 2 used in the first embodiment is arranged to have a volume resistivity in the range of $10^6$ to $10^{10}$ Ω·cm, and preferably $10^8$ to $10^{10}$ Ω·cm. Further, the surface resistivity thereof is arranged to be in the range of $10^6$ to $10^{12}$ Ω/sq. and preferably $10^8$ to $10^{12}$ Ω/sq. Furthermore, it is desirable to arrange the Young's modulus (a modulus of longitudinal elasticity) of the base layer to be 3000 MPa or higher. It is necessary for the base layer to have a sufficient mechanical strength to tolerate stretching, bending, wrinkling, and undulating while being driven. By using the intermediate transfer belt 2 having the elasticity of such a level, the elastic layer is able to follow recessed parts of recording paper, even if the recording paper has a low pulp-density, has unevenness of 20 to 30 μm on the surface thereof (e.g., embossed paper), or the like. This configuration is known to achieve an advantageous effect of improving solid fillability where toner exhibits excellent transferability so as to be transferred to recessed parts of recording paper.

Other examples of the intermediate transfer belt 2 include mono-layer structure belts. As a specific example, the intermediate transfer belt 2 may have a mono-layer configured with resin having medium resistance obtained by adjusting the resistance of a material such as polyimide (PI), polyamide-imide (PAI), polycarbonate (PC), ethylene tetrafluoroethylene (ETFE), polyvinylidene fluoride (PVDF), polyphenylenesulfide (PPS), or the like, by performing a carbon dispersion process thereon or adding an ion conductive agent thereto. Further, it is acceptable to use a belt in which a surface layer having electrical resistance slightly higher than the volume resistivity of the layer of the belt itself is provided only on the top surface side of the intermediate transfer belt 2 having the mono-layer structure. In that situation, it is desirable to arrange the thickness of the surface layer to be approximately 1 to 10 μm.

The reason is because providing a higher-resistance layer on the surface is known to improve a phenomenon called "white spots" that occurs when the secondary transfer process is performed on paper that has once gone through a fixing process and is in a state where the amount of moisture therein is small while the resistance thereof is high, the secondary transfer process being performed by using, in particular, a belt of such a type where the resistance control is executed by dispersing carbon into resin. The phenomenon called "white spots" occurs when a path in which the transfer current flows in a concentrated manner is created due to variations in the carbon dispersion state so that the toner in the corresponding parts is scattered and missing, and therefore blank spots are formed in the image. By providing the higher-resistance layer on the surface, it is possible to improve abnormal images having "white spots" by mitigating the local concentration of the transfer current.

Next, transfer bias correction control for the primary transfer process that is executed by the controller 200 serving as a controller included in the copying machine 1 described above will be explained.

In the first embodiment, an example in which the transfer bias is controlled by using a current value will be explained. However, the configuration may similarly be applied to a situation in which the transfer bias is controlled by using a voltage value and is not limited to the example described below.

Generally speaking, the larger is the current value of the transfer current, the better the transfer rate is and the larger amount of toner is transferred onto a transfer member. However, if the transfer current is raised to a higher level than necessary, image degradation occurs where the transfer rate conversely becomes lower and/or where the transferred toner image exhibits density unevenness. This applies to both the primary transfer process and the secondary transfer process. In addition, while an image forming operation is repeatedly performed, it is common for the developer to become deteriorated and for the toner charge amount of the developer (more specifically, a specific charge (Q/M) expressed as a charge amount per unit mass of the developer) to gradually become smaller. When the toner charge amount becomes smaller, an optimal value for the transfer current (the primary transfer current) also changes, the transfer current being required by the transfer of the toner images from the photoconductors to the transfer member. Accordingly, it is desirable to correct the primary transfer current in accordance with the degree of deterioration of the developer so as to inhibit the degradation of image quality in accordance with the degree of deterioration of the developer.

Further, diligent studies of the inventors of the present disclosure have revealed that the transfer rate also varies depending on the pattern of the image to be formed (an image area ratio in the main-scanning direction) and that differences in the image area ratio in the main-scanning direction have a larger impact when, in particular, the Q/M value has become smaller.

Figure 2:
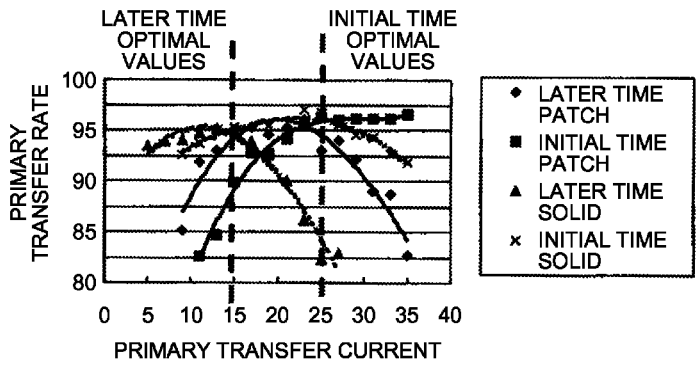
FIG. 2 is a chart indicating a relationship between a primary transfer rate and a primary transfer current with respect to toner images having mutually-different main-scanning-direction image area ratios at an initial time and a later time.

FIG. 2 is a chart indicating a relationship between the primary transfer rate and the transfer current with respect to toner images having mutually-different main-scanning-direction image area ratios, at an initial time when the developer had not yet deteriorated and at a later time when the developer became deteriorated.

The chart indicates the relationships between the primary transfer rate and the primary transfer current for a patch image and a solid image, at the initial time when the developer had not yet deteriorated and at the later time when the developer became deteriorated. The patch image is a monochrome completely-solid image that is set with a maximum density and has a size of 20 mm long (in the main-scanning direction) by 10 mm wide (in the sub-scanning direction). The solid image is a monochrome completely-solid image that is set with a maximum density and has a size of 20 mm long by 300 mm wide.

As illustrated in FIG. 2, each of the plotted lines indicates a relationship where there is a primary transfer current value (a peak) that achieves the highest primary transfer rate. It is observed, however, that the relationships are different between the initial time and the later time, and also, between the patch image and the solid image.

At the initial time when the developer had not yet deteriorated, a primary transfer current value that achieved the highest possible primary transfer rate (97%) within such a range where approximately equal primary transfer rates were achieved for both the patch image and the solid image is set as an initial optimal value (25 μA) indicated in FIG. 2.

In contrast, at the later time when the developer became deteriorated, the relationships between the primary transfer rate and the primary transfer current for the patch image and for the solid image are indicated in FIG. 2. In this situation, it is observed that the primary transfer current value (the peak) that achieved the highest primary transfer rate for the solid image at the later time shifts, by a large amount, toward the lower primary transfer current (absolute value) side, compared to that at the initial time. If an image forming operation is performed at the later time while maintaining the primary transfer current value (25 μA) of the initial time, a primary transfer rate of approximately 93% is achieved for the patch image as indicated in FIG. 2; however, the primary transfer rate for the completely-solid image drops down to approximately 85%.

At the later time, an optimal value for the primary transfer current that achieved the highest possible primary transfer rate (93%) within such a range where approximately equal primary transfer rates were achieved for both the patch image and the solid image is indicated in FIG. 2 as a later-time optimal value (15 μA). As explained here, because the optimal value for the primary transfer current at the later time shifts, by a large amount, toward the smaller absolute value side compared to that at the initial time, it is desirable to make a correction so as to lower the primary transfer current in accordance with the degree of deterioration of the developer.

In this situation, because the shift in the transfer rate between the initial time and the later time is heavily correlated with the degree of deterioration of the developer, i.e., the degree of decrease in the toner charge amount (Q/M). Thus, it is possible to use the transfer rate shift as a parameter for finding out the degree of deterioration of the developer.

Figure 3:
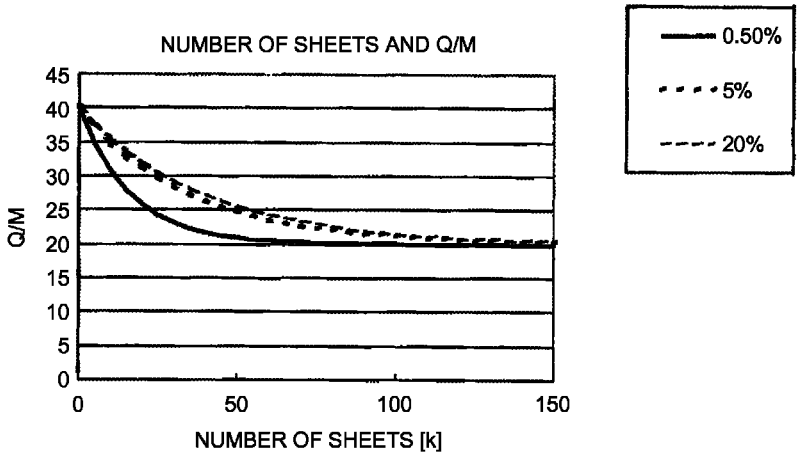
FIG. 3 is a chart showing a relationship between the number of image formed sheets (the number of sheets printed) and a toner charge amount (Q/M)

FIG. 3 is a chart indicating a relationship between the number of image formed sheets (the number of sheets printed) and the toner charge amount (Q/M).

The chart indicates transitions of the toner charge amount (Q/M) when images having image area ratios of 0.5%, 5%, and 20% were continuously formed. From the chart in FIG. 3, it is observed that the lower the image area ratio of the formed images was, the more quickly the toner charge amount (Q/M) decreased. It is considered that the reasons can be explained as follows: the lower the image area ratio is, the smaller the consumption amount of the toner in the developing device 6 is; As a result, because a larger amount of toner stays inside the developing device 6, a larger stress is applied to the toner.

Figure 4:
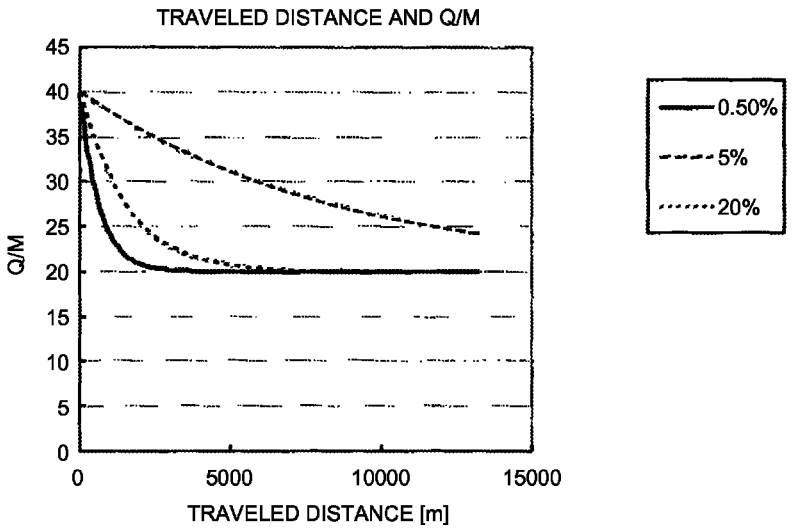
FIG. 4 is a chart showing a relationship between a developer conveyance distance and the toner charge amount (Q/M)

FIG. 4 is a chart indicating a relationship between a developer conveyance distance and the toner charge amount (Q/M).

The chart indicates transitions of the toner charge amount (Q/M) when images having image area ratios of 0.5%, 5%, and 20% were continuously formed. From the chart in FIG. 4, it is observed that toner charge amount (Q/M) decreased quickly, not only when the image area ratio was low (0.5%) but also when the image area ratio was high (20%). In this situation, as for the developer conveyance distance, an estimated value calculated by multiplying a process linear velocity (a photoconductor linear velocity) by an operation time of the developing device may be used.

When FIG. 3 is compared with FIG. 4, it is suspected that the following problem may occur if the transition of the toner charge amount is estimated simply on the basis of only the number of image formed sheets (the number of sheets printed) or only the developer conveyance distance, and the primary transfer current is corrected according to the estimated toner charge amount: there is a possibility that the primary transfer current may not appropriately be corrected because the estimated value of the toner charge amount may have a large error depending on statuses of the image forming operation (differences in the image area ratios). To solve this problem, it is desirable to estimate the degree of deterioration of the developer while taking into consideration not only the number of image formed sheets (the number of sheets printed) and the developer conveyance distance, but also the statuses of the image forming operation (the differences in the image area ratios).

To cope with this situation, in the first embodiment, transfer current temporal correction patterns are formed at the time of execution of an image adjustment process control. On the basis of a detection result regarding image densities of the patterns, the degree of decrease in the Q/M value (the degree of deterioration of the developer) over the course of time is determined so as to correct the transfer current to an optimal level.

A setting value for the primary transfer current in the first embodiment is calculated by using Expression (1) shown below:

$$\text{Setting value} = (\text{reference current value}) \times (\text{environment correction coefficient}) \times (\text{temporal correction coefficient}) \quad (1)$$

The reference current value is a primary transfer current value used as a reference that is determined on the basis of the type of the paper, the thickness of the paper, the linear velocity, and the like.

The environment correction amount is a correction coefficient depending on changes in the environment such as temperature, humidity, and the like. In the first embodiment, a temperature-humidity sensor (not shown; CHS-CSC-18 manufactured by TDK) that serves as an environment information obtaining unit is used, so as to obtain temperature information from a thermistor output of the temperature-humidity sensor and to obtain humidity information from a humidity sensor output of the temperature-humidity sensor. As for the detection timing of the temperature/humidity information, the information is sampled once every minute after the power supply is turned on. Further, as for the timing for making an environment correction with respect to the reference current value, a cycle similar to that of the temperature/humidity detection timing may be used. The location where the temperature-humidity sensor is installed is not particularly limited. It is, however, preferable to keep the temperature-humidity sensor away from heat sources such as the fixing device 11. In the first embodiment, the temperature-humidity sensor is provided underneath the paper feeding unit 15, for example.

Figure 5:
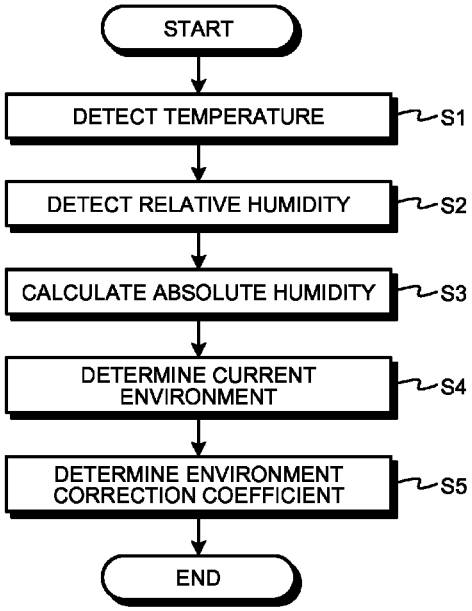
FIG. 5 is a flowchart of an example of a process of determining an environment correction amount (an environment correction coefficient) according to the first embodiment.

FIG. 5 is a flowchart of an example of a process of determining the environment correction amount (the environment correction coefficient) according to the first embodiment.

First, a thermistor output of the temperature-humidity sensor is detected, and the temperature is determined by referring to a thermistor output/temperature conversion table based on a correlational relationship between thermistor outputs and temperature (step S1).

Next, a humidity sensor output of the temperature-humidity sensor is detected, and a relative humidity is determined on the basis of the temperature determined above and a humidity sensor output/relative humidity conversion table (step S2). The humidity sensor output/relative humidity conversion table shows temperature values in the rows and humidity values in the columns so that relative humidity values can be found.

After that, an absolute humidity is calculated on the basis of the relative humidity determined above and a relative humidity/absolute humidity conversion table (step S3). The relative humidity/absolute humidity conversion table shows relative humidity values in rows and temperature values in columns so that absolute humidity values can be found. It is also possible to calculate the absolute humidity from the temperature and the relative humidity by using a calculation formula.

Subsequently, an environment at present is determined on the basis of the absolute humidity determined above and an absolute humidity/current environment conversion table (step S4). To determine the environment at present, it is judged which one of the environment ranges determined in advance applies to the situation at present. Examples of the environment ranges are: L/L (19° C./30%); M/L (23° C./30%); M/M (23° C./50%); M/H (23° C./80%); and H/H (27° C./80%). The values of temperature and humidity and the combinations thereof to define the environment ranges are not limited to these examples.

Lastly, an environment correction coefficient (an environment correction amount) is determined in accordance with the environment at present determined above (step S5). For example, the environment correction coefficient may be 90% when the environment range is L/L and may be 110% when the environment range is H/H. However, the relationship between the environment at present and the environment correction coefficient is not limited to this example.

Because the detection using the temperature-humidity sensor does not require any mechanical operations, it is possible to monitor the environment at all times and to execute sequential control in response to fluctuations in the environment.

Next, a method for determining the temporal correction amount (the temporal correction coefficient) according to the first embodiment will be explained. In the first embodiment, the temporal correction amount is determined by forming the transfer current temporal correction patterns, in addition to image adjustment patterns formed at the time of execution of the image adjustment process control. Next, the image adjustment process control will be explained.

First, the image quality adjustment control (the process control) according to the first embodiment will be explained.

To execute image quality adjustment control, a test pattern is generated so as to execute image density control and positional shift control on the basis of detection results regarding the image density and the image formation position of the test pattern. To execute the image density control, for example, a toner adhesion amount (the image density) of a density control pattern (an image quality adjustment pattern) obtained by developing a predetermined pattern latent image is detected. Further, in accordance with the detection result regarding the toner adhesion amount, the toner concentration in the developer within the developing device, writing conditions (e.g., an exposure power) used by the writing device 5, and setting values for a charging bias, a developing bias, and the like are changed. To execute the positional shift control, for example, latent image writing timing for the toner images in the different colors is adjusted on the basis of detection timing of a positional shift control pattern (another image quality adjustment pattern).

As for the detection locations of the image quality adjustment patterns described above, the density control pattern may be detected, for example, on the photoconductor in an area between the developing area and the primary transfer part or may be detected on the intermediate transfer belt after the primary transfer process is performed thereon. However, when the diameter of the photoconductor is small, because it is difficult to detect the pattern on the photoconductor due to the space required by the installation of an image density detection sensor, it is preferable to detect the pattern on the intermediate transfer belt. As for the positional shift control pattern, because it is necessary to observe positional shifts among the toner images in the different colors that are caused by variations in inter-photoconductor distances and positional shifts related to writing timing of the latent images in the different colors, it is essential to detect the pattern on a surface movement member that bears the toner images and is positioned after the intermediate transfer belt. In the first embodiment, both the density control pattern and the positional shift control pattern are detected on the intermediate transfer belt 2.

The image quality adjustment control (the process control) is, generally speaking, performed during a non-image-forming-operation period other than image-forming-operation periods, e.g., when the power supply is turned on, before a printing job (an image forming operation) is started, after a printing job is finished, every time a predetermined number of sheets of images have been formed, or the like. However, to further stabilize the image quality, it is also acceptable to execute image quality adjustment control also during an image-forming-operation period, by forming an image quality adjustment pattern between sheets of recording paper, which is a non-image area between an image area (an image section to be transferred onto one sheet of recording member) and another image area, and detecting the formed pattern. Alternatively, during an image-forming-operation period, it is also acceptable to form an image quality adjustment pattern in a non-image area positioned on the outside of an image area in terms of the width direction (the direction orthogonal to the surface movement direction of the photoconductors 3) and to detect the formed pattern. The image quality adjustment control that is executed during an image-forming-operation period in this manner is used for sequentially controlling a toner concentration control reference value (a target toner concentration level) used by a toner concentration sensor configured with a magnetic permeability sensor or the like.

Next, characteristic parts of the first embodiment will be explained.

In the first embodiment, the temporal correction amount is determined by forming the transfer current temporal correction patterns, in addition to the image adjustment patterns described above.

Figure 6:
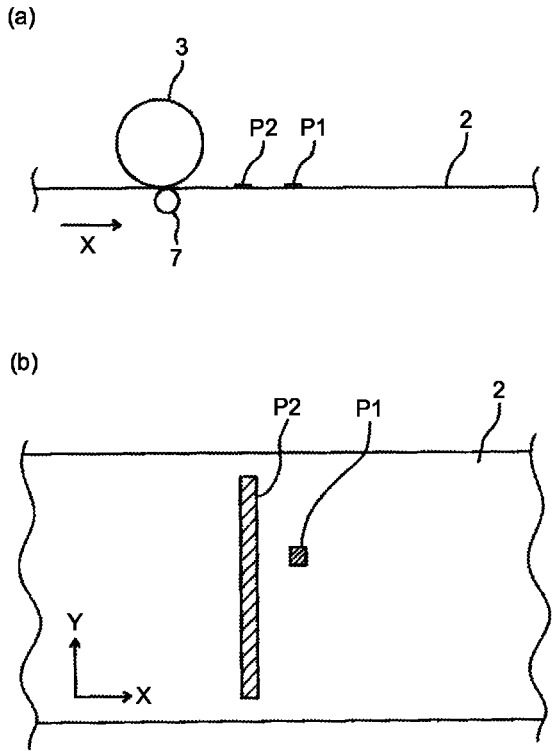
FIG. 6 is a drawing for explaining transfer current temporal correction patterns.

FIG. 6 is a drawing for explaining the transfer current temporal correction patterns.

As the transfer current temporal correction patterns, a transversal band pattern P2 extending in the main-scanning direction (the Y direction in FIG. 6) and a patch-like pattern P1 are formed on the surface of the photoconductor 3 under mutually the same image formation condition except for the shapes of the images and are subsequently transferred onto the surface of the intermediate transfer belt 2. After that, by using an optical sensor 300, image densities (toner adhesion amounts) ID on the surface of the intermediate transfer belt 2 are detected, with respect to the patch-like pattern P1 having a smaller image area ratio and the transversal band pattern P2 having a higher image area ratio. On the basis of the detection result, an image density difference ΔID between the transversal band pattern P2 and the patch-like pattern P1 is calculated. As explained below, the image density difference ΔID exhibits a relationship where the larger the image density difference ΔID is the higher the degree of decrease in the toner charge amount is.

More specifically, as indicated in the chart in FIG. 2, when the primary transfer process was performed by using the optimal primary transfer current value (the initial optimal value) at the initial time when the developer had not yet deteriorated, the primary transfer rates were approximately equal (approximately 97%) between the patch image and the solid image at the initial time. In contrast, between the patch image and the solid image at the later time when the developer became deteriorated, the primary transfer rate for the patch image was approximately 94%, whereas the primary transfer rate for the solid image was approximately 84%. A large difference was observed between the transfer rates of these images. In other words, a correlational relationship was observed where the difference in the primary transfer rates between the patch image and the solid image became larger, as the toner charge amount decreased due to the progress of the deterioration of the developer. From this correlational relationship, it is possible to derive the relationship where the larger the image density difference ΔID is, the higher the degree of deterioration of the developer (the degree of decrease in the toner charge amount) is, the image density difference ΔID being calculated from the image density results between the transversal band pattern P2 and the patch-like pattern P1 formed on the intermediate transfer belt 2.

Accordingly, as for the temporal correction amount, it is possible to diminish the difference in the transfer rates caused by the difference in the image area ratios, by decreasing the correction amount when the image density difference ΔID is smaller and increasing the correction amount when the image density difference ΔID is larger.

At the time when the image quality adjustment control (the process control) is executed in the first embodiment, the toner images of the transfer current temporal correction patterns are formed on the surface of the photoconductor 3. Of the transfer current temporal correction patterns, the patch-like pattern P1 is a monochrome completely-solid image that is set with a maximum density and has a size of 20 mm long by 10 mm wide; the transversal band pattern P2 is a monochrome completely-solid image that is set with a maximum density and has a size of 20 mm long by 300 mm wide. As for the dimensions, the length in the lengthwise direction corresponds to the length in the sub-scanning direction (the X direction in FIG. 6), whereas the length in the widthwise direction corresponds to the length in the main-scanning direction (the Y direction in FIG. 6).

The toner images of the transfer current temporal correction patterns formed in this manner are transferred onto the intermediate transfer belt 2. In that situation, the primary transfer current value is the initial transfer value for which the temporal correction amount is not taken into consideration. Thus, the setting value thereof can be calculated as follows: "the setting value=the reference current value×an environment correction coefficient".

The image densities of the toner images of the transfer current temporal correction patterns transferred on the intermediate transfer belt 2 are measured by the optical sensor 300 that is positioned over and opposite to the intermediate transfer belt 2, so that the image density difference ΔID is calculated.

In the first embodiment, for each of the colors of yellow, magenta, cyan, and black, the toner images of the transfer current temporal correction patterns described above are formed, the image densities are measured, and the image density difference ΔID is calculated. However, as explained below, as for black, because the level of precision in the detection process becomes low when the maximum density is used, it is also acceptable to form the toner image by using a density lower than the maximum density (lower than 0.35 $mg/cm^2$). The transfer current temporal correction patterns used for finding out the degree of deterioration of the developer are not limited to the examples described above.

Subsequently, the temporal correction amount (the temporal correction coefficient) is determined on the basis of the calculated image density difference ΔID.

Figure 7:
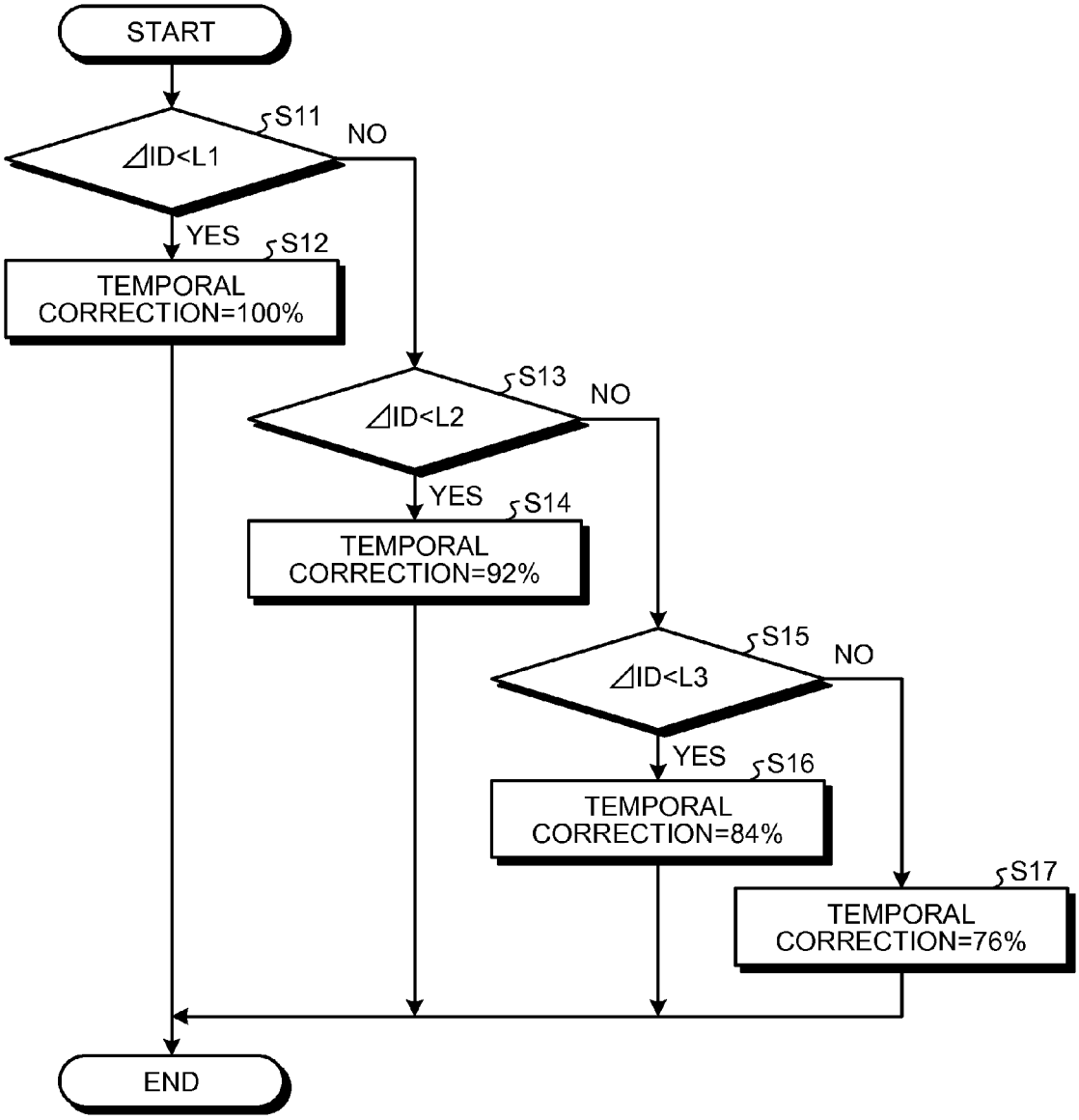
FIG. 7 is a flowchart of an example of a process of determining a temporal correction amount (a temporal correction coefficient) according to the first embodiment.

FIG. 7 is a flowchart of an example of a process of determining the temporal correction amount (the temporal correction coefficient) according to the first embodiment.

As explained above, the temporal correction amount in the first embodiment is calculated by using the image density difference ΔID between the patch-like pattern P1 and the transversal band pattern P2. More specifically, it is judged whether the calculated image density difference ΔID is smaller than a threshold value L1 (step S11). If it is determined that the image density difference ΔID is smaller than the threshold value L1 (step S11: Yes), the temporal correction coefficient is determined to be 100% (step S12).

On the contrary, if it is determined that the image density difference ΔID is equal to or larger than the threshold value L1 (step S11: No), it is then judged whether the image density difference ΔID is smaller than a threshold value L2 (step S13). In this judgment process, if it is determined that the image density difference ΔID is smaller than the threshold value L2 (step S13: Yes), the temporal correction coefficient is determined to be 92% (step S14). On the contrary, if it is determined that the image density difference ΔID is equal to or larger than the threshold value L2 (step S13: No), it is then judged whether the image density difference ΔID is smaller than a threshold value L3 (step S15). In this judgment process, if it is determined that the image density difference ΔID is smaller than the threshold value L3 (step S15: Yes), the temporal correction coefficient is determined to be 84% (step S16). On the contrary, if it is determined that the image density difference ΔID is equal to or larger than the threshold value L3 (step S15: No), the temporal correction coefficient is determined to be 76% (step S17).

In the first embodiment, the threshold values are arranged as L1=0.08; L2=0.14; and L3=0.20. However, possible embodiments are not limited to these examples. Further, although the image density difference ΔID of the developer is divided into the four sections by using the three threshold value in the above example, it is also acceptable to divide the image density difference ΔID into a smaller number of sections or a larger number of sections. Further, from the aspects of simplifying the control and reducing the cost, it is also acceptable to execute the control described above only at the black station or the station positioned on the most downstream side.

In the first embodiment described above, the example is explained in which the transversal band pattern P2 and the patch-like pattern P1 are formed as the transfer current temporal correction patterns, which are formed in addition to the image adjustment patterns. However, it is also acceptable to use the toner adhesion amount of the patch-like pattern used in the image quality adjustment control (the process control), as the toner adhesion amount of the patch-like pattern P1 used for calculating the image density difference ΔID. With this arrangement, it is possible to reduce the number of transfer current temporal correction patterns that are formed in addition to the image adjustment patterns.

Next, a conventional image forming apparatus will be explained.

An example of known conventional image forming apparatuses is configured as follows: An electrostatic latent image is formed on a photoconductor on the basis of image data. A toner image is generated by developing the electrostatic latent image by using toner. Further, the generated toner image is transferred from the photoconductor to an intermediate transfer member, by applying a transfer bias thereto from a primary transfer unit. Further, the image is transferred from the intermediate transfer member to recording paper by a secondary transfer unit. The recording paper and the intermediate transfer member are separated from each other by applying a separating bias thereto from a separating unit. An image is formed by performing a fixing process using heat and pressure on the recording paper on which the toner image has been placed.

In the image forming apparatus configured as described above, the toner image is transferred onto the intermediate transfer member by applying the transfer bias thereto from the transfer unit. Depending on the bias value of the transfer bias, the percentage of the toner transferred onto the intermediate transfer member changes.

The larger the transfer bias value is, the better the transfer rate is and the larger amount of toner is transferred onto the recording paper via the intermediate transfer member. However, it is empirically known that, if the transfer bias is raised to a higher level than necessary, the transfer rate becomes lower, and the transferred toner image exhibits density unevenness.

The transfer rate is known to vary depending on the size, thickness, and the material of the recording paper, temperature, humidity, the toner charge amount (Q/M) on the photoconductor, the toner adhesion amount, the transfer unit becoming unclean, and the like. In addition, the transfer rate is known to vary also depending on a moisture containing state of the recording paper, a close adhesion state between the recording paper and the photoconductor, the rotation speed of the photoconductor, the conveyance speed of the recording paper, and the like. Thus, it is necessary to adjust the transfer bias while taking these various conditions into consideration. In particular, changes in the toner charge amount have a large impact on the transfer.

Further, it is common for image forming apparatuses of the type described above that the charge amount of the developer (more specifically, the specific charge (Q/M) expressed as a charge amount per unit mass of the developer) gradually changes while the image forming process is repeatedly performed. When the charge amount changes, the optimal value for the transfer bias to be supplied to the transfer member also changes, the transfer bias being used for transferring the developer image from the photoconductor to a transfer member such as the intermediate transfer member. Thus, in Japanese Patent No. 3,172,557, for example, the transfer bias value (the current value or the voltage value) to be supplied to a transfer member is controlled, for instance, in accordance with the number of image formed sheets.

According to Japanese Patent No. 3,172,557, however, although it is possible to set the transfer bias to a value corresponding to the change in the toner charge amount caused by the deterioration over the course of time (hereinafter, "temporal deterioration"), effects of the formed image patterns are not taken into account. The effects of the formed image patterns can be explained as follows: For example, the image quality may become unstable depending on image area ratios, which vary depending on whether the image is a completely-solid image, a line-shaped longitudinal band image, or a patch-like image. It is considered that the reason why the image quality can become unstable depending on the image area ratios is that, for example, the amount of toner and the like forming the image varies depending on whether the image is a completely-solid image or a line-shaped image.

In particular, diligent studies of the inventors of the present disclosure have revealed that changes in the Q/M value of toner have a large impact on image quality becoming unstable dependent on the image area ratios. More specifically, the toner charge amount (Q/M) decreases due to temporal deterioration, depending on the use environment and the number of sheets printed. When the toner charge amount (Q/M) decreases, the fluctuation width of the transfer rate dependent on the image area ratios changes. For example, at the beginning when the developer starts being used, a certain transfer bias that is able to achieve excellent transferability for both images having a low image area ratio and images having a high image area ratio is set as an initial transfer bias. While using the initial transfer bias, when the toner charge amount (Q/M) decreases due to temporal deterioration, there is a possibility that even though it is possible to keep excellent transferability (transfer rate) for images having a low image area ratio, an insufficient transfer may occur for images having a high image area ratio. In other words, because the shift width of the transfer rate dependent on the image area ratio fluctuates due to the temporal deterioration, the value of the transfer current that is able to diminish the fluctuation in the transfer rate caused by the changes in the image area ratio also shifts depending on the degree of deterioration of the developer.

For this reason, it is in demand to provide an image forming apparatus capable of performing an excellent transfer process regardless of image patterns, while using toner of which the Q/M value has fluctuated due to temporal deterioration.

In the first embodiment, by forming the transfer current temporal correction patterns including the transversal band pattern P2 and the patch-like pattern P1 and detecting the image densities, it is possible to detect the image density for a low image area ratio and the image density for a high image area ratio. Further, if the image density difference ΔID, which is the difference between the detected image densities, is small, the temporal correction amount for the transfer current is arranged to be small. On the contrary, if the image density difference ΔID is large, the temporal correction amount is arranged to be large. With these arrangements, even if the developer is in a deteriorated state from the temporal deterioration, it is possible to diminish the difference in the transfer rates caused by the difference in the image area ratios.

More specifically, if there is a large difference in the image densities between the patch-like pattern P1 and the transversal band pattern P2, it means that the toner charge amount (Q/M) has decreased and that the dependency of the image area ratio on the transfer rate is high. On the contrary, if there is a small difference in the image densities, it means that the toner charge amount (Q/M) has not so much decreased and that the dependency of the image area ratio on the transfer rate is low. Thus, by correcting the transfer current in accordance with the difference in the image densities between the patch-like pattern P1 and the transversal band pattern P2, it is possible to make the correction in accordance with the degree of decrease in the toner charge amount (Q/M). Accordingly, by using an optimal temporal correction amount adjusted to the dependency of the image area ratio on the transfer rate, it is possible to perform an excellent transfer process regardless of image patterns even at a later time.

Further, the control executed in the first embodiment where the temporal correction amount for the transfer current is determined on the basis of the value of the image density difference ΔID is especially effective with toner having a low volume resistivity. Conventionally, it had been considered preferable to use toner having volume resistance higher than 10.7 log·Ω·cm, in order to realize the charge in a developing device and the charge in a transfer part through a charge-up process (a charge injection).

In recent years, however, as a result of selecting resin that is able to achieve fixability at a low temperature in particular, there are some situations where toner having volume resistance of 10.7 log·Ω·cm or lower is used. It is therefore necessary to use different types of toners in different situations.

To measure the volume resistance, 3 grams [g] of toner particle powder was shaped into a pellet having a thickness of approximately 3 mm by using an electric pressing machine. The pellet was then placed on a dielectric loss measuring device (TR-10C manufactured by Ando Electric Co., Ltd) to measure the volume resistance.

A problem with toner having a low volume resistivity is that it is difficult to hold the electric charge. The reason is presumed to be that apparent electrostatic capacity decreases due to the low resistance. Thus, when the charging capability of the carrier has decreased over the course of time, toner having a low volume resistivity is known to experience a decrease in the toner charge amount more easily than the conventional toner having a high volume resistivity.

When the toner charge amount has decreased over the course of time, a problem becomes prominent where images no longer have an enough density at a later time due to an excessive transfer, because the optimal transfer current values diverge between the initial time and the later time, especially for images (completely-solid images) having a high image area ratio. In that situation, it is especially effective to lower the transfer current over the course of time as explained above.

Next, the timing with which the control (hereinafter, "transfer current temporal correction control") according to the first embodiment is executed so as to form the transfer current temporal correction patterns, to detect the image density difference ΔID from the image densities of the formed patterns, and to correct the transfer current value will be explained.

As for the timing thereof, it is not necessary to perform the transfer current temporal correction control every time the image quality adjustment control (the process control) is executed. As indicated in FIGS. 3 and 4, as for the decrease in the toner charge amount (Q/M), the decreasing ratio is high in the initial period immediately after the start of the use, and the decreasing ratio gradually becomes lower over the course of time. If the transfer current temporal correction control was executed every time the image quality adjustment control is executed, waiting periods of the user would increase and the toner would be consumed wastefully. Thus, it is possible to correct the transfer current more efficiently by executing the transfer current temporal correction control more frequently during the initial period when the toner charge amount (Q/M) changes significantly and gradually prolonging the time interval with which the transfer current temporal correction control is executed.

Figure 8:
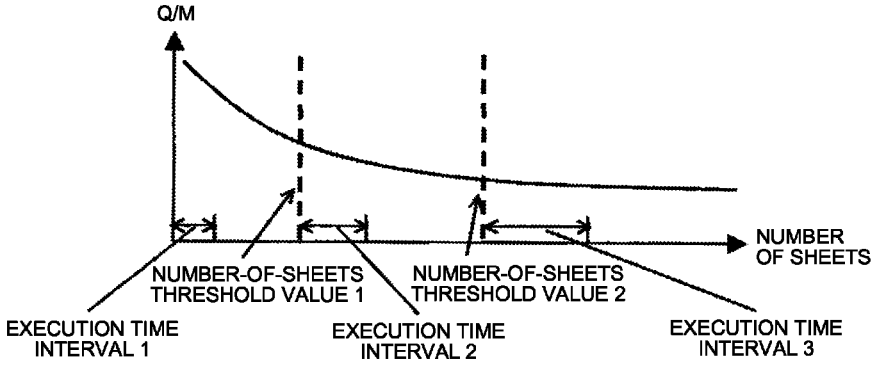
FIG. 8 is a drawing for explaining an exemplary configuration in which time intervals for transfer current temporal correction control are prolonged over the course of time.

FIG. 8 is a drawing for explaining an exemplary configuration in which the time intervals for the transfer current temporal correction control are prolonged over the course of time. The curve in FIG. 8 indicates an example of a fluctuation in the toner charge amount (Q/M) in relation to the number of image formed sheets and indicates that the decreasing ratio of the toner charge amount (Q/M) becomes lower over the course of time.

As indicated in FIG. 8, the transfer current temporal correction control is executed with "execution time interval 1" from the start of the use until "number-of-sheets threshold value 1" is reached. After that, the transfer current temporal correction control is executed with "execution time interval 2" until "number-of-sheets threshold value 2" is reached. After the "number-of-sheets threshold value 2" is reached, the transfer current temporal correction control is executed with "execution time interval 3". The transfer current temporal correction control is executed at the same time when the image quality adjustment control is executed immediately after the number of sheets corresponding to the execution time interval is exceeded.

In the first embodiment, "number-of-sheets threshold value 1" is set to 10,000 sheets, "number-of-sheets threshold value 2" is set to 50,000 sheets, "execution time interval 1" is set to 200 sheets, "execution time interval 2" is set to 1,000 sheets, and "execution time interval 3" is set to 2,000 sheets. With these settings, it was possible to correct the transfer current efficiently; however, the number-of-sheets threshold values and the execution time intervals are not limited to these examples.

As for the timing, the transfer current correction control may be executed independently of the timing with which the image quality adjustment control is executed. However, by executing the transfer current correction control when executing the image quality adjustment control, it is possible to collectively execute the different types of control that may cause waiting periods for the users. It is therefore possible to reduce the frequency with which waiting periods are caused for the users.

Further, it is also acceptable to execute the transfer current correction control between sheets of recording paper (during the time or time interval between the end of an immediately-preceding image forming process and the start of a following image forming process). In that situation, it is possible to reduce waiting periods for the users and to reduce correction time lags, because the transfer current correction control does not have to be performed at the same time with the image quality adjustment control and because the correction is made immediately.

Further, in the first embodiment, an upper limit value is set for the temporal correction amount for the transfer current. During the transfer current temporal correcting process, the transfer current is corrected to be lower in accordance with the decrease in the toner charge amount (Q/M). However, if the transfer current is reduced excessively, a side effect such as what is called a "scattered transfer" may be caused. For this reason, the setting is made so that the transfer current is corrected within such a range that causes no side effects.

In the first embodiment, as explained above, the toner adhesion amounts of the different types of patterns formed on the intermediate transfer belt 2 are detected by the optical sensor 300 serving as an optical detector, and the toner adhesion amounts of the toner patches are calculated by using the detected values and a predetermined adhesion-amount calculation algorithm.

When a black toner adhesion amount is to be detected, a characteristic is known where it is not possible to achieve sensitivity for diffuse reflection light, because the light emitted by the optical sensor 300 is absorbed at the surface of the toner. For this reason, for the black toner, the toner adhesion amount is detected by using only regular reflection light. Further, when the adhesion amount is detected by using only the regular reflection light, the sensitivity decreases as the toner adhesion amount increases. Thus, the detection range for the adhesion amount for the black toner is narrower than that for the toner in the other colors where the adhesion is detected by using both diffuse reflection light and regular reflection light. Accordingly, in the first embodiment, for the purpose of detecting the adhesion amount with a higher level of precision, it is also acceptable to form a pattern with such a developing bias that makes the adhesion amounts of the toner patches in black smaller (0.35 mg/cm$^2$ or smaller) than the toner adhesion amount for a solid density.

A Modification Example

Figure 9:
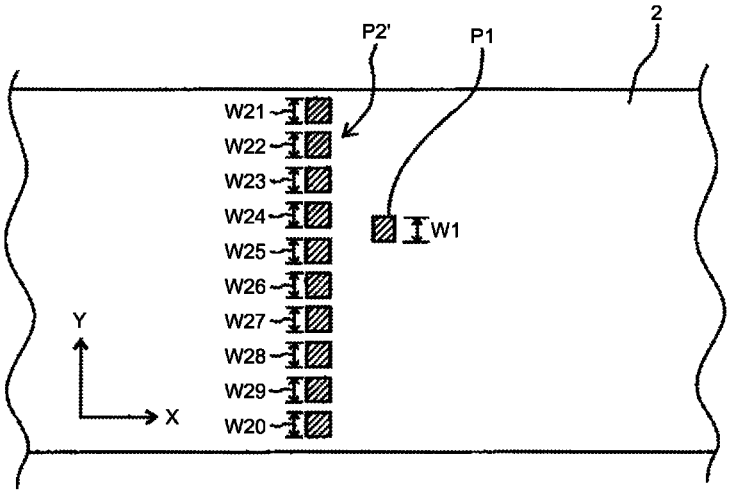
FIG. 9 is a drawing for explaining transfer current temporal correction patterns according to a modification example.

FIG. 9 is a drawing for explaining transfer current temporal correction patterns according to a modification example.

In the first embodiment described above, the patch-like pattern P1 and the transversal band pattern P2 are used as the plurality of types of transfer current temporal correction patterns (density detection patterns) that have mutually-different lengths in the main-scanning direction, which is the direction orthogonal to the surface movement direction of the photoconductor 3. These transfer current temporal correction patterns are realized as the toner images that are successively formed in the main-scanning direction.

In contrast, in the modification example shown in FIG. 9, to form a transfer current temporal correction pattern that is longitudinal along the main-scanning direction, a plurality of patch-like patterns P2' in which a plurality of toner images are arranged along the main-scanning direction are used, instead of the transversal band pattern P2.

The total length of the plurality of patch-like patterns P2' in the main-scanning direction can be calculated by adding together the lengths of the ten patches (W21+W22+ . . . +W29+W20). Thus, the total length of the images is longer than that of the patch-like pattern P1 of which the length in the main-scanning direction is W1.

When the patter image is formed in sections of a plurality of patches like the plurality of patch-like patterns P2', the length of the transfer current temporal correction pattern in the main-scanning correction is defined as the total of the lengths of the plurality of patches in the main-scanning direction.

Preferred embodiments of the first embodiment have thus been explained. The present invention, however, is not limited to those specific embodiments. As long as no particular limitation is imposed in the above explanation, various modifications and changes are possible within the scope of the gist of the present invention set forth in the claims. For example, from the aspect of simplifying the control, the detection of the degree of deterioration of the developer and the judgment of whether the degree of deterioration of the developer has reached a level that requires a temporal correction of the primary transfer current do not necessarily always have to be performed on all the image formation units included in the copying machine. For example, the detection and/or the judgment may be performed only on such an image formation unit that is employed during the particular image forming process. The control on the primary transfer bias may be executed by controlling the voltage value, instead of controlling the current value. The developer may be a one-component developer including toner or may be a two-component developer including toner and a carrier. The environment detection sensor may be provided for each of the image formation units.

Second Embodiment

Figure 10:
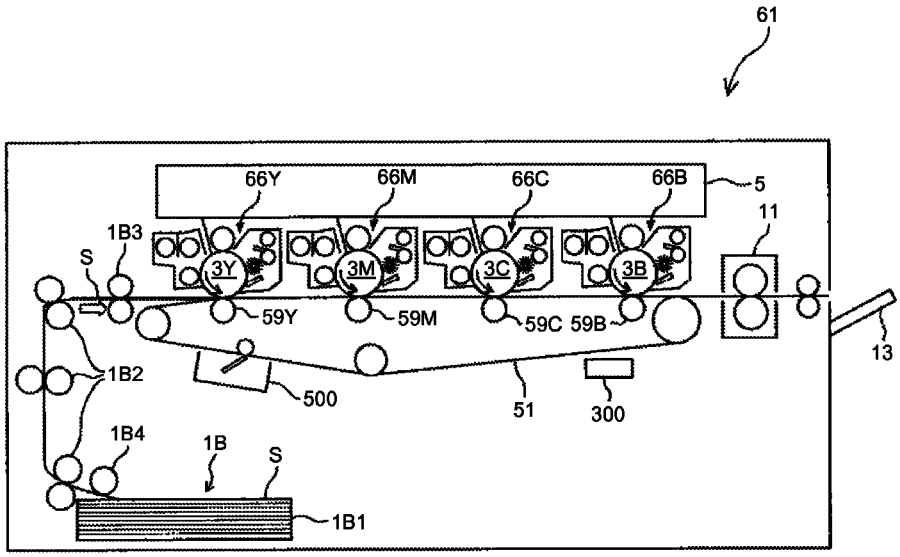
FIG. 10 is a schematic diagram of a printer according to a second embodiment.

Next, a second embodiment of an image forming apparatus to which the present invention is applied will be explained. FIG. 10 is a schematic explanatory diagram of a printer 61, which is an image forming apparatus according to the second embodiment.

It is possible to similarly apply the present invention not only to image forming apparatuses implementing a so-called intermediate transfer method such as the copying machine 1 shown in FIG. 1, but also to image forming apparatuses implementing a direct transfer method such as the printer 61 shown in FIG. 10. The printer 61 is configured so that a transfer part is formed between each of the four photoconductors 3 (M, C, Y, and B) in the four image formation units 66 (M, C, Y, and B) and a transfer belt 51. Bias rollers 59 (M, C, Y, and B) abut against the inner circumferential surface of portions of the transfer belt forming the transfer parts.

The printer 61 is configured so that recording paper S is conveyed while being borne on the surface of the transfer belt 51 that rotates clockwise in FIG. 10. Further, when the recording paper S borne on the surface of the transfer belt 51 sequentially passes through the four transfer parts, toner images formed on the four photoconductors 3 (M, C, Y, and B) are each transferred onto the recording paper S.

A transfer bias power supply (not shown) is connected to the bias rollers 59, so as to apply a transfer bias to each of the transfer parts.

The recording paper S sent out from the paper feeding cassette 1B1 included in the paper feeding unit 1B by a pickup roller 1B4 is conveyed by the plurality of conveying rollers 1B2 and abuts against the registration rollers 1B3 positioned on the upstream side of the transfer belt 51 in terms of the paper conveyance direction. After that, the recording paper S is forwarded from the registration rollers 1B3 to the transfer belt 51 and is conveyed to the transfer parts positioned between the photoconductors 3 and the transfer belt 51. At the transfer parts, the toner images formed on the photoconductors 3 are transferred onto the recording paper S. The recording paper S that has passed through the four transfer parts is forwarded from the transfer belt 51 to the fixing device 11, so that the unfixed images borne on the surface are fixed by the fixing device 11, before the recording paper S is ejected into the paper ejection tray 13.

In the printer 61 shown in FIG. 10 implementing the direct transfer method, the optical sensor 300 is positioned opposite to the surface of the transfer belt 51. In addition, a transfer belt cleaning device 500 is provided on the downstream side, in terms of the surface movement direction, of the part of the transfer belt 51 positioned opposite to the optical sensor 300.

The transfer current temporal correction patterns formed on the surfaces of the photoconductors 3 are transferred from the photoconductors 3 onto the transfer belt 51 while the recording paper S is not present at the transfer parts. After that, the image densities (the toner adhesion amounts) ID of the transfer current temporal correction patterns transferred on the transfer belt 51 are detected on the surface of the transfer belt 51 by using the optical sensor 300.

Like in the copying machine 1 described above in the first embodiment, the printer 61 shown in FIG. 10 is also configured to detect the image densities of the plurality of types of transfer current temporal correction patterns transferred on the surface of the transfer belt 51 and to calculate an image density difference between the plurality of types of transfer current temporal correction patterns. After that, the transfer bias applied to the bias rollers 59 is corrected on the basis of the value of the image density difference. As a result, similarly to the copying machine 1 according to the first embodiment, it is possible to set the transfer bias to a value corresponding to the degree of deterioration of the developer, and it is therefore possible to inhibit degradation of the image quality.

The printer 61 shown in FIG. 10 is an image forming apparatus implementing the direct transfer method and is therefore different from the copying machine 1, which is an image forming apparatus implementing the intermediate transfer method. However, for the other configurations of the printer 61, the same configurations as those of the copying machine 1 can be applied thereto, as appropriate.

Third Embodiment

Figure 11:
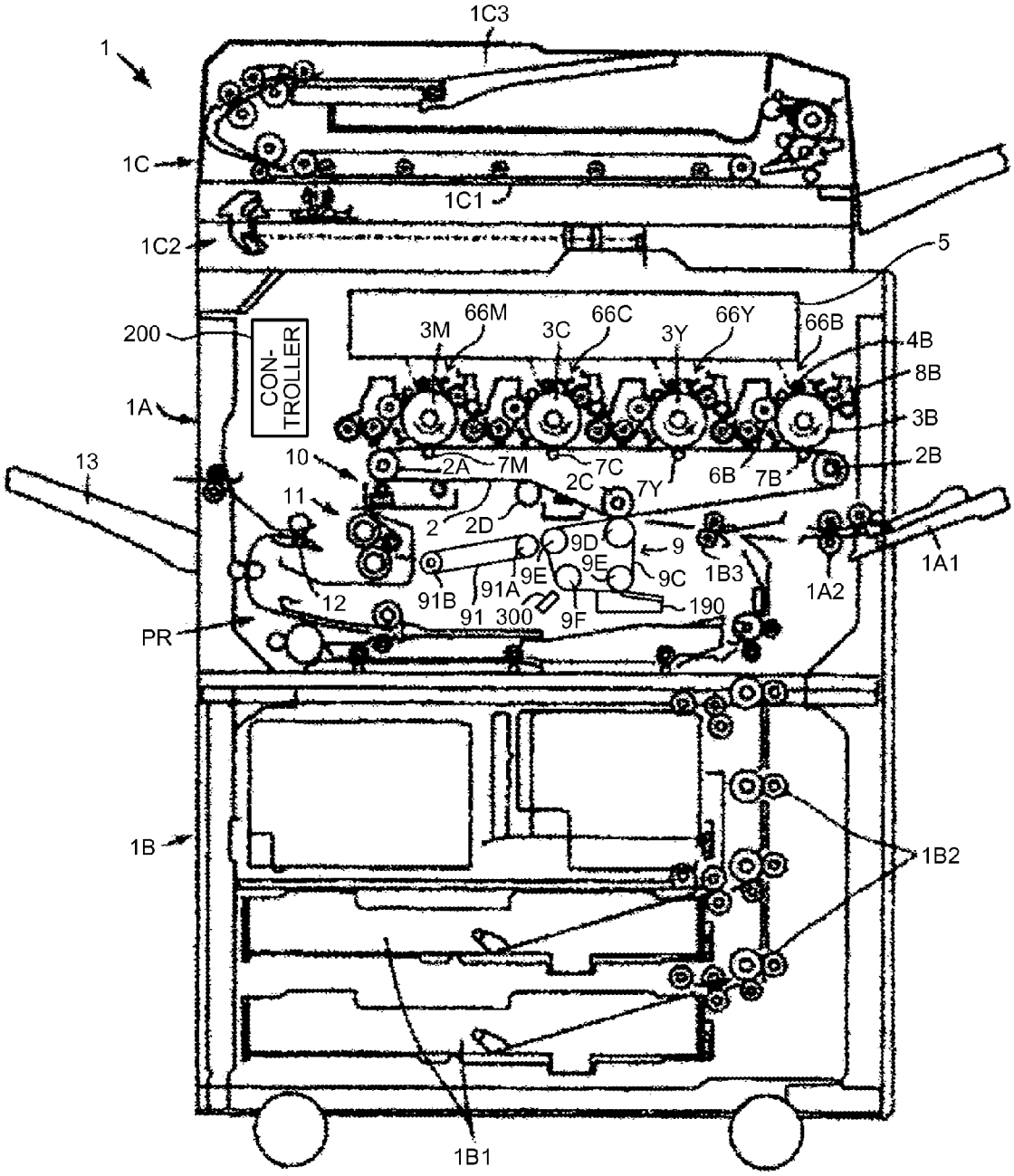
FIG. 11 is a schematic diagram of an overall configuration of a copying machine according to a third embodiment.

Next, a third embodiment of an image forming apparatus to which the present invention is applied will be explained. FIG. 11 is a schematic explanatory diagram of the copying machine 1 serving an image forming apparatus according to the third embodiment.

The copying machine 1 according to the third embodiment shown in FIG. 11 is different from the copying machine 1 according to the first embodiment shown in FIG. 1, because of the configuration of the secondary transfer device 9 and the position of the optical sensor 300. Because the other features are the same, the explanation about the same features will be omitted, so that only the different features will be explained.

As shown in FIG. 11, the secondary transfer device 9 includes the secondary transfer belt 9C. The secondary transfer belt 9C is spanned around four secondary transfer belt supporting rollers (9D, 9E, 9F, and 9G). Further, when one of the four secondary transfer belt supporting rollers is driven to rotate as a driving roller, the secondary transfer belt 9C rotates counterclockwise in FIG. 11.

The copying machine 1 according to the third embodiment shown in FIG. 11 is configured so that the length of the secondary transfer belt 9C in the left-and-right direction of the drawing is shorter than that in the copying machine 1 according to the first embodiment shown in FIG. 1. A conveying belt 91 is provided between the secondary transfer belt 9C and the fixing device 11. The conveying belt 91 is spanned around a conveying belt driving roller 91A and a conveying belt driven roller 91B. When the conveying belt driving roller 91A is driven to rotate, the conveying belt 91 rotates counterclockwise in FIG. 11.

The optical sensor 300 is provided in a position opposite to the surface of the secondary transfer belt 9C, so as to be on the downstream side, in terms of the surface movement direction of the secondary transfer belt 9C, of a secondary transfer part where the secondary transfer belt 9C is positioned opposite to the intermediate transfer belt 2. Further, a secondary transfer belt cleaning device 90 configured to remove foreign substances from the surface of the secondary transfer belt 9C is provided on the downstream side, in terms of the surface movement direction of the secondary transfer belt 9C, of the position opposite to the optical sensor 300.

One of the four secondary transfer belt supporting rollers is a secondary transfer roller 9D which is positioned opposite to the secondary transfer opposite roller 2C in the secondary transfer part while the secondary transfer belt 9C and the intermediate transfer belt 2 are interposed therebetween and to which a secondary transfer bias is applied. Further, provided on the left side of the secondary transfer roller 9D is a separation roller 9E that has the secondary transfer belt 9C stretched thereon in a paper separation part where recording paper that has passed through the secondary transfer part and is borne on the surface of the secondary transfer belt 9C is forwarded to the conveying belt 91. A sensor opposite roller 9F is provided so as to have the secondary transfer belt 9C stretched thereon in a detection position where the secondary transfer belt 9C on the separation roller 9E becomes opposite to the optical sensor 300. Further, provided on the right side of the sensor opposite roller 9F and underneath the secondary transfer roller 9D is a secondary transfer belt cleaning opposite roller 9G that has the secondary transfer belt 9C stretched thereon in a position where a cleaning blade of the secondary transfer belt cleaning device 90 comes in contact therewith.

In the copying machine 1 according to the third embodiment, when one of the four secondary transfer belt supporting rollers is driven to rotate as a driving roller, the surface of the secondary transfer belt 9C moves in the same direction as the intermediate transfer belt 2 in the secondary transfer part where the secondary transfer belt 9C is in contact with the intermediate transfer belt 2. Although the circumstances may vary depending on bias characteristics of the primary transfer device, it is also acceptable, like in the first embodiment, to provide the secondary transfer roller 9D with an electrically charging characteristic so that recording paper is electrostatically adsorbed. During the process of the recording paper being conveyed by the secondary transfer belt 9C, the secondary transfer device 9 transfers either a superimposed toner image or a monochrome toner image formed on the intermediate transfer belt 2 onto the recording paper.

When the toner images corresponding to the different colors have been transferred onto the intermediate transfer belt 2 in a superimposed manner by performing the same process as the one performed by the copying machine 1 according to the first embodiment shown in FIG. 1, the superimposed toner images undergo the collective secondary transfer process to be transferred onto the recording paper by the secondary transfer device 9. The recording paper on which the secondary transfer process has been performed is conveyed toward the left side of the drawing due to the surface movement of the secondary transfer belt 9C, is separated from the secondary transfer belt 9C at the position of the separation roller 9E, and is then forwarded to the conveying belt 91. The conveying belt 91 conveys the recording paper forwarded from the secondary transfer belt 9C to the fixing device 11. The unfixed image borne on the surface of the recording paper that has reached the fixing device 11 is fixed by the fixing device 11. The processes performed after the fixing process are the same as those performed in the copying machine 1 according to the first embodiment shown in FIG. 1.

The secondary transfer belt 9C used in the third embodiment is configured with a three-layer belt in which, on a base layer of 50 to 100 μm, an elastic layer of 100 to 500 μm is provided, underneath a surface layer that is further provided. As a specific example, the base layer may be configured by using resin having medium resistance obtained by adjusting the resistance of a material such as polyimide (PI), polyamide-imide (PAI), polycarbonate (PC), ethylene tetrafluoroethylene (ETFE), polyvinylidene fluoride (PVDF), polyphenylenesulfide (PPS), or the like, by performing a carbon dispersion process thereon or adding an ion conductive agent thereto. As a specific example, the elastic layer may be configured so as to include a material obtained by adjusting the resistance of a rubber material such as urethane, NBR, CR, or the like, by similarly performing a carbon dispersion process thereon or adding an ion conductive agent thereto. As a specific example, the surface layer may be configured by applying a coating of fluorine-based rubber or resin (or a hybrid material of these) having a thickness of approximately 1 to 10 μm to the surface of the elastic layer.

The secondary transfer belt 9C used in the third embodiment is arranged to have a volume resistivity in the range of $10^6$ to $10^{10}$ Ω·cm, and preferably $10^8$ to $10^{10}$ Ω·cm. Further, the surface resistivity thereof is arranged to be in the range of $10^6$ to $10^{12}$ Ω/sq., and preferably $10^8$ to $10^{12}$ Ω/sq. Furthermore, it is desirable to arrange the Young's modulus (a modulus of longitudinal elasticity) of the base layer to be 3000 Mpa or higher. It is necessary for the base layer to have a sufficient mechanical strength to tolerate stretching, bending, wrinkling, and undulating while being driven.

Other examples of the secondary transfer belt 9C include a mono-layer structure belt. As a specific example, the secondary transfer belt 9C may have a mono-layer configured with resin having medium resistance obtained by adjusting the resistance of a material such as polyimide (PI), polyamide-imide (PAI), polycarbonate (PC), ethylene tetrafluoroethylene (ETFE), polyvinylidene fluoride (PVDF), polyphenylenesulfide (PPS), or the like, by performing carbon dispersion process thereon or adding an ion conductive agent thereto. Further, it is acceptable to use a belt in which a surface layer having electrical resistance slightly higher than the volume resistivity of the layer of the belt itself is provided only on the top surface side of the secondary transfer belt 9C having the mono-layer structure. In that situation, it is desirable to arrange the thickness of the surface layer to be approximately 1 to 10 μm.

As explained in the first embodiment, the larger is the current value of the transfer current, the better the transfer rate is and the larger amount of toner is transferred onto the transfer member. However, if the transfer current is raised to a higher level than necessary, image degradation occurs where the transfer rate conversely becomes lower and/or where the transferred toner image exhibits density unevenness. This applies to both the primary transfer process and the secondary transfer process.

For this reason, like the primary transfer current, an optimal value for the secondary transfer current at a later time shifts, by a large amount, toward the smaller absolute value side, compared to that at an initial time. It is therefore desirable to make a correction so as to lower the secondary transfer current in accordance with the degree of deterioration of the developer. In addition, as explained above, it is desirable to estimate the degree of deterioration of the developer while taking into consideration not only the number of image formed sheets (the number of sheets printed) and the developer conveyance distance, but also the statuses of the image forming operation (the differences in the image area ratios).

In the third embodiment, transfer current temporal correction patterns are formed at the time of the image adjustment process control. On the basis of a detection result regarding the image densities of the patterns, the degree of decrease in the Q/M value (the degree of deterioration of the developer) over the course of time is determined so as to correct the primary transfer current and the secondary transfer current to optimal transfer current values.

Like the primary transfer current in the first embodiment described above, setting values for the primary transfer current and the secondary transfer current in the third embodiment are calculated by using Expression (1) shown below:

$$\text{(Setting value)}=\text{(reference current value)}\times\text{(environment correction coefficient)}\times\text{(temporal correction coefficient)} \quad (1)$$

The reference current value is a primary transfer current value or a secondary transfer current value used as a reference that is determined on the basis of the type of the paper, the thickness of the paper, the linear velocity, and the like.

The environment correction amount is a correction coefficient depending on changes in the environment such as temperature, humidity, and the like. In the third embodiment, like in the first embodiment, the temperature-humidity sensor (not shown; CHS-CSC-18 manufactured by TDK) that serves as an environment information obtaining unit is used, so as to obtain temperature information from a thermistor output of the temperature-humidity sensor and to obtain humidity information from a humidity sensor output of the temperature-humidity sensor. As for the detection timing of the temperature/humidity information, the information is sampled once every minute after the power supply is turned on. Further, as for the timing for making an environment correction with respect to the reference current value, a cycle similar to that of the temperature/humidity detection timing may be used.

The location where the temperature-humidity sensor is installed is not particularly limited. It is, however, preferable to keep the temperature-humidity sensor away from heat sources such as the fixing device 11. In the third embodiment, like in the first embodiment, the temperature-humidity sensor is provided underneath the paper feeding unit 1B, for example.

In the third embodiment, both the primary transfer current and the secondary transfer current are calculated by using Expression (1) presented above. It is, however, also acceptable to calculate only one of the transfer currents by using Expression (1).

The control that is executed to determine the environment correction amount (the environment correction coefficient) in the third embodiment may be the same as the control executed in the first embodiment explained with reference to FIG. 5.

The image quality adjustment control (the process control) executed in the third embodiment is also similar to the control executed in the first embodiment. However, the configuration is different from the first embodiment described above, because the image quality adjustment pattern formed during the image quality adjustment control is detected on the secondary transfer belt 9C in the third embodiment.

In the copying machine 1 according to the third embodiment shown in FIG. 11, the optical sensor 300 is positioned opposite to the surface of the secondary transfer belt 9C. In addition, the secondary transfer belt cleaning device 90 is provided on the downstream side, in terms of the surface movement direction of the secondary transfer belt 9C, of the position opposite to the optical sensor 300.

The transfer current temporal correction patterns formed on the surfaces of the photoconductors 3 are transferred onto the intermediate transfer belt 2 (a primary transfer process) and are then transferred from the intermediate transfer belt 2 onto the secondary transfer belt 9C while the recording paper is not present at the secondary transfer parts. After that, the image densities (the toner adhesion amounts) ID of the transfer current temporal correction patterns transferred onto the secondary transfer belt 9C are detected on the surface of the secondary transfer belt 9C by using the optical sensor 300.

The transfer current temporal correction patterns that are formed on the surface of the secondary transfer belt 9C and have passed through the position opposite to the optical sensor 300 are removed from the surface of the secondary transfer belt 9C by the secondary transfer belt cleaning device 90.

Of the image quality adjustment patterns, when the diameter of the photoconductor is small, it is difficult to detect the density control pattern on the photoconductor due to the space required by the installation of an image density detection sensor. In contrast, it is possible to detect the density control pattern on the secondary transfer belt 9C without any problems. As for the positional shift control pattern, it is necessary to observe positional shifts among the toner images in the different colors that are caused by variations in inter-photoconductor distances and positional shifts related to writing timing of the latent images in the different colors. In the third embodiment, because the toner images in which positional shifts occurred on the intermediate transfer belt 2 are transferred, it is possible to observe the positional shifts among the toner images in the different colors. In the third embodiment, both the density control pattern and the positional shift control pattern are detected on the secondary transfer belt 9C.

Conventionally, it has been common for many image forming apparatuses of medium-to-low speed models to include, instead of a belt-like member, a small-diameter roller-like member as a secondary transfer member that is positioned opposite to the intermediate transfer belt 2 in the secondary transfer part and is configured to form a secondary transfer electric field between the secondary transfer opposite roller 2C and itself. When such a roller-like member is used as the secondary transfer member, it is difficult to detect the image quality adjustment pattern on the surface of the secondary transfer member. In contrast, in the third embodiment, because the apparatus includes the secondary transfer belt 9C as the secondary transfer member, as illustrated in FIG. 11, it is possible to detect the image quality adjustment pattern on the surface of the secondary transfer member.

Further, the secondary transfer member is not limited to a belt-like member, and a roller having a large diameter may be used instead. However, if a roller-like member was used, the detection position of the optical sensor 300 would be curved. It would therefore be necessary to arrange the diameter of the roller to be large, which is disadvantageous from the aspect of saving space. In contrast, by using a belt-like member such as the secondary transfer belt 9C, it is possible to improve the flexibility in designing the layout. Further, when a belt-like member is used, it is relatively easier to configure the detection position of the optical sensor 300 to be on a flat plane. It is therefore possible to improve the level of precision in the detection process.

In the copying machine 1 according to the first embodiment, the image densities of the image quality adjustment patterns are detected on the intermediate transfer belt 2. However, if it is difficult to optically detect the image quality adjustment patterns on the intermediate transfer belt 2, it is possible to adopt the configuration of the third embodiment where the image quality adjustment patterns are detected on the surface of the secondary transfer belt 9C. The factor that makes it difficult to detect the image densities on the intermediate transfer belt 2 varies depending on the specifications of the model. For example, restrictions from the type of belt material used in the intermediate transfer belt 2 may be a factor.

As for a requirement for the intermediate transfer belt 2, in order to be able to form images on various types of recording media, the intermediate transfer belt 2 is expected to have followability, at the secondary transfer part, with surfaces of recording media having various surface characteristics.

As for the surface followability, it has become popular in recent years to form images on various types of recording media by using full-color electrophotography. Further, not only regular smooth paper but also various recording media are becoming popular, ranging from paper that is very smooth and slippery such as coated paper to paper that has a rough surface such as recycled paper, embossed paper, Japanese paper, craft paper, or the like. Thus, it is important for the intermediate transfer belt 2 to have surface followability at the secondary transfer part, so as to be able to follow various types of recording media having various surface characteristics. If the surface followability is not sufficient, toner images transferred on the recording media may exhibit density unevenness or tone unevenness.

As an example of the intermediate transfer belt 2 that has followability for various types of recording media, an intermediate transfer belt is described in Japanese Patent Application Laid-open No. 2012-208485.

Figure 12:
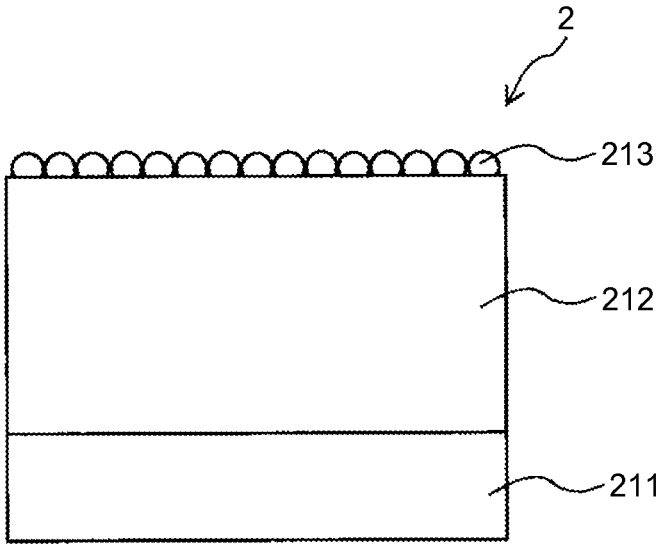
FIG. 12 is an enlarged cross-sectional view of a layer structure of an intermediate transfer belt having the same structure as that of an intermediate transfer belt described in Japanese Patent Application Laid-open No. 2012-208485.

FIG. 12 is an enlarged cross-sectional view of a layer structure of the intermediate transfer belt 2 having the same configuration as that of the intermediate transfer belt described in Japanese Patent Application Laid-open No. 2012-208485.

In the intermediate transfer belt 2 shown in FIG. 12, on top of a base layer 211 that is rigid and relatively flexible, a soft elastic layer 212 is laminated, underneath the fine particles that are laminated on the top surface as a surface layer 213.

First, the base layer 211 will be explained.

Examples of a material that can be used for the base layer 211 include a resin material containing a so-called electrical-resistance adjusting material such as a filler (or an additive) that adjusts electrical resistance.

As the resin material used in the base layer 211, for example, fluorine-based resin such as PVDF or ETFE, or polyimide or polyamide-imide resin is preferable from the aspect of flame retardancy. In particular, polyimide or polyamide-imide resin is preferable from the aspect of mechanical strength (high elasticity) and heat resistance.

Examples of the electrical-resistance adjusting material to be contained in the resin material of the base layer 211 include a metal oxide, carbon black, an ion conductive agent, and an electrically-conductive polymer.

Next, the elastic layer 212 laminated on the base layer 211 will be explained.

The elastic layer 212 may be configured with a rubber elastic layer, such as acrylic rubber as a specific example. The acrylic rubber may be any of the products that are currently on the market and has no particular limitation. However, from among various types of cross-linking systems (epoxy groups, active chlorine groups, and carboxyl groups) for acrylic rubber, it is preferable to select a carboxylic-group cross-linking system, because carboxylic-group cross-linking systems have excellent rubber characteristics (especially, a compression set) and workability.

Next, the surface layer 213 that is formed on the elastic layer 212 and is configured with spherical fine resin particles will be explained. Any material can be used as the material for the fine particles used as the spherical fine resin particles. Possible examples include spherical fine resin particles (hereinafter, simply referred to as "fine resin particles") of which the main component is one or more type of resins selected from the following: acrylic resin, melamine resin, polyamide resin, polyester resin, silicone resin, fluorine resin, and the like. Alternatively, it is also acceptable to use a material obtained by applying a surface treatment using a different type of material to the surfaces of the fine particles configured with any of these resin materials.

Further, examples of the fine resin particles described above also include rubber materials. It is also possible to use a material obtained by coating the surfaces of spherical fine resin particles made of a rubber material with hard resin.

Further, the fine resin particles may be configured to be hollow or porous.

From among the different types of resin made of the different materials, it is most preferable to use silicone resin fine particles because of smoothness and high levels of releasability for toner and abrasion resistance.

As for the fine resin particles, it is preferable to use fine particles that are formed into spherical shapes by implementing a polymerization method or the like. The higher the sphericity of the fine particles is, the more preferable. Further, as for the particle diameters, it is preferable if the volume-average particle diameter is within the range between 0.5 μm and 5 μm and if the distribution thereof exhibits a sharp monodispersion. If the average particle diameter is smaller than 0.5 μm, it is difficult to evenly apply the fine particles to the surface of the acrylic rubber elastic layer, because the fine particles have a prominent cohesion. On the contrary, if the average particle diameter exceeds 5 μm, the belt surface after the application of the fine particles exhibits projections and recesses that are too large. If such a belt is used as the intermediate transfer belt 2, a cleaning failure may occur during a cleaning process performed by the belt cleaning device 10.

The elastic layer 212 is configured to have a Martens hardness in the range from 0.2 to 0.8 $N/mm^2$ with an indentation of 10 μm. The surface layer 213 provided on the surface of the elastic layer 212 is formed to have uniform projections and recesses of independent spherical resin particles that are aligned in the planar direction. By using the intermediate transfer belt 2 configured in this manner, it is possible to achieve excellent followability with the surface of various types of recording media at the secondary transfer part, while ensuring releasability for the toner realized by the surface layer 213.

Further, by using a flame-retardant acrylic rubber elastic layer that is graded as VTM-0 in a UL94VTM flammability test as the elastic layer 212, it is possible to realize excellent flame retardancy while ensuring excellent followability.

Specific examples of the base layer 211, the elastic layer 212, and the surface layer 213 included in the intermediate transfer belt 2 can be configured as described in Japanese Patent Application Laid-open No. 2012-208485; however, possible embodiments are not limited to these examples.

By using the intermediate transfer belt 2 including the elastic layer 212 as shown in FIG. 12, it is possible to form excellent images on various types of recording medium while suppressing density unevenness and tone unevenness, because the surface of the intermediate transfer belt 2 is able to follow paper with uneven surface exhibiting surface roughness.

However, generally speaking, the rubber material used in the elastic layer 212 has a low level of releasability for toner. Thus, unless the surface layer made of another material having excellent releasability for toner was provided, it would be difficult to realize a product that can withstand practical use, because of a low secondary transfer rate and insufficient cleanability.

As an example of a conventional intermediate transfer belt including an elastic layer, a belt provided with a coating layer on the surface of the elastic layer is known. More specifically, by applying liquid serving as a material for the coating layer to the surface of the elastic layer and drying the applied liquid, it is possible to produce a belt in which the coating layer is provided on the surface of the elastic layer.

However, the material used for the coating layer is unable to change the form thereof in accordance with deformations over the course of time where the rubber material used in the elastic layer expands and contracts. When the belt keeps being used, the coating layer will crack, which causes the surface of the belt to crack. When the cracks are caused, the transferability and cleanability of the toner adhered to the cracked parts become low.

In contrast, in the intermediate transfer belt 2 shown in FIG. 12, the surface layer 213 is configured by covering the entire area of the surface of the elastic layer 212 with the fine resin particles. Thus, when a deformation occurs in such a manner that the surface side of the elastic layer 212 expands, the fine resin particles shift the positions thereof so that the spaces between adjacently-positioned particles are enlarged. When a deformation occurs in such a manner that the surface side of the elastic layer 212 contracts, the fine resin particles shift the positions thereof so that the spaces between adjacently-positioned particles are reduced. Thus, even if the rubber material used in the elastic layer 212 experiences the deformations, only the positional relationship among the fine resin particles changes, and no cracks or the like are caused. Thus, it is possible to maintain stable releasability for toner over the course of time and to maintain transferability and cleanability of the toner.

Of the intermediate transfer belt 2 shown in FIG. 12, however, because the surface layer 213 is configured by covering the entire area thereof with the fine resin particles, the surface has low levels of smoothness and glossiness. Further, when the surface having a low level of smoothness is irradiated with light, a diffuse reflection is caused. It is therefore not possible to detect the toner adhesion amounts by using the optical sensor 300.

In contrast, the secondary transfer belt 9C is not intended to bear the toner images to be transferred onto a recording medium. Thus, the secondary transfer belt 9C is not required to have followability for uneven surfaces of recording media. Accordingly, it is possible to use a material having a high level of smoothness such as polyimide.

Consequently, when the intermediate transfer belt 2 shown in FIG. 12 is used, it is desirable, as described in the third embodiment, to transfer the transfer current temporal correction patterns formed on the intermediate transfer belt 2 onto the secondary transfer belt 9C and to further detect the toner adhesion amounts by using the optical sensor 300.

By using the intermediate transfer belt 2 shown in FIG. 12 for the copying machine 1 according to the third embodiment, it is possible to improve the followability of the surface of the intermediate transfer belt 2 for uneven surfaces of recording media and to form excellent images on various types of recording media. In addition, it is possible to maintain stable releasability for the toner over the course of time and to maintain transferability and cleanability of the toner. Thus, it is possible to form excellent images over the course of time. Furthermore, it is possible to appropriately detect the toner adhesion amounts, by transferring the transfer current temporal correction patterns onto the secondary transfer belt 9C and detecting the toner adhesion amounts by using the optical sensor 300. As a result, it is possible to appropriately execute the transfer current temporal correction control and to appropriately diminish the difference in the transfer rates caused by the difference in the image area ratios, even if the developer is in a deteriorated state from the temporal deterioration.

Incidentally, another image forming apparatus may be designed while allowing the possibility of cracks being caused, by using the intermediate transfer belt 2 that has an elastic layer without the layer structure shown in FIG. 12, has a coating layer formed on the surface of the elastic layer, and has a possibility of having cracks. When this image forming apparatus is used while allowing the possibility of the releasability for toner being degraded by the cracks, even if an attempt is made to measure the toner adhesion amounts on the intermediate transfer belt 2 by using a reflection of light, it is not possible to detect the toner adhesion amounts accurately because the reflection of the light changes at the cracked parts. Even if such an image forming apparatus including the intermediate transfer belt 2 that may have cracks is used, it is possible to improve the level of precision in the detection of the toner adhesion amounts by using the configuration in which the transfer current temporal correction patterns are transferred onto the secondary transfer belt 9C so that the optical sensor 300 detects the toner adhesion amounts.

Next, a positional arrangement of the optical sensor 300 in the copying machine 1 according to the third embodiment will be explained.

Figure 13:
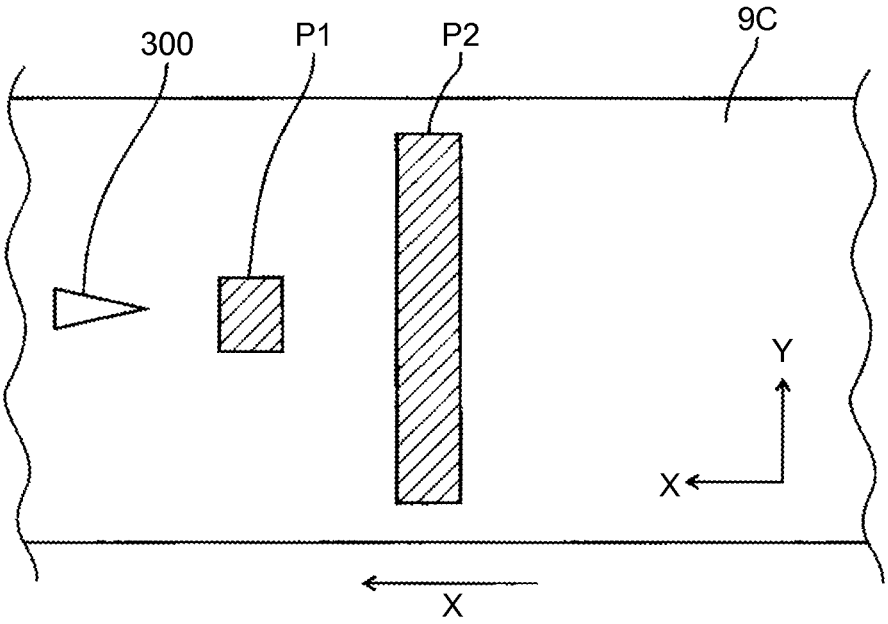
FIG. 13 is a schematic diagram of a configuration in which image densities of a patch-like pattern and a transversal band pattern on a surface of a secondary transfer belt are detected by using a single optical sensor.

FIG. 13 is a schematic diagram of a configuration in which the image densities ID of the patch-like pattern P1 and the transversal band pattern P2 on the surface of the secondary transfer belt 9C are detected by using the single optical sensor 300. The direction of the arrow X in FIG. 13 corresponds to the surface movement direction of the secondary transfer belt 9C, whereas the direction of the arrow Y in FIG. 13 corresponds to the main-scanning direction.

In the configuration in FIG. 13, the detection position of the optical sensor 300 is one location. The patch-like pattern P1 is formed in such a manner that the position thereof on the secondary transfer belt 9C in terms of the main-scanning direction corresponds to the detection position of the optical sensor 300. With this arrangement, it is possible to detect the image density ID of the patch-like pattern P1 by using the optical sensor 300. As for the transversal band pattern P2 having a higher image area ratio, because a part thereof passes through the detection position of the optical sensor 300, it is possible to detect the image density ID of the transversal band pattern P2 by using the optical sensor 300.

When the image density difference ΔID is to be calculated for each of the toner images in the four colors, patch-like patterns P1 in the different colors are formed in the detection position of the optical sensor 300. At that time, the patch-like patterns P1 in the different colors are formed while the positions thereof in the conveyance direction are varied. Further, the transversal band patterns P2 having a higher image area ratio are also formed while the positions thereof in the conveyance direction are varied among the different colors. With these arrangements, it is possible to detect the image densities ID of the patch-like patterns P1 and the transversal band patterns P2 in the four colors, by using the single optical sensor 300.

Figure 14:
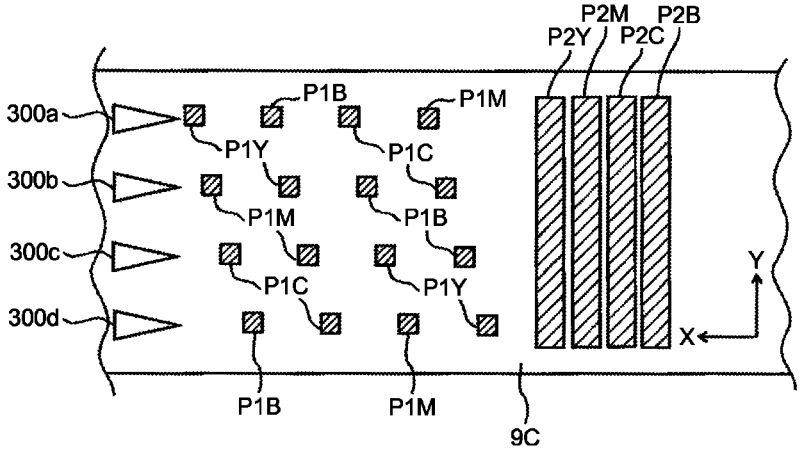
FIG. 14 is a schematic diagram of a configuration in which image densities of patch-like patterns and transversal band patterns on a surface of a secondary transfer belt are detected by using a plurality of optical sensors.

FIG. 14 illustrates a configuration in which the image densities of the patch-like patterns P1 and the transversal band patterns P2 on the surface of the secondary transfer belt 9C are detected by using four optical sensors 300. The direction of the arrow X in FIG. 14 corresponds to the surface movement direction of the secondary transfer belt 9C, whereas the direction of the arrow Y in FIG. 14 corresponds to the main-scanning direction.

In the configuration illustrated in FIG. 14, the optical sensors 300 (a first optical sensor 300*a* to a fourth optical sensor 300*d*) are provided in four locations along the main-scanning direction.

In the configuration illustrated in FIG. 14, four patch-like patterns P1 are formed in each color, and one transversal band pattern P2 is formed in each color.

A first yellow patch-like pattern P1Y is formed in such a manner that the position thereof on the secondary transfer belt 9C in the main-scanning direction corresponds to the detection position of the first optical sensor 300*a*. Further, second, third, and fourth yellow patch-like patterns P1Y are formed so as to correspond to the detection positions of the second, the third, and the fourth optical sensors (300*b*, 300*c*, and 300*d*), respectively.

A first magenta patch-like pattern P1M is formed in such a manner that the position thereof on the secondary transfer belt 9C in the main-scanning direction corresponds to the detection position of the second optical sensor 300*b*. Further, second, third, and fourth magenta patch-like patterns P1M are formed so as to correspond to the detection positions of the third, the fourth, and the first optical sensors (300*c*, 300*d*, and 300*a*), respectively.

A first cyan patch-like pattern P1C is formed in such a manner that the position thereof on the secondary transfer belt 9C in the main-scanning direction corresponds to the detection position of the third optical sensor 300*c*. Further, second, third, and fourth cyan patch-like patterns P1C are formed so as to correspond to the detection positions of the fourth, the first, and the second optical sensors (300*d*, 300*a*, and 300*b*), respectively.

A first black patch-like pattern P1B is formed in such a manner that the position thereof on the secondary transfer belt 9C in the main-scanning direction corresponds to the detection position of the fourth optical sensor 300*d*. Further, second, third, and fourth black patch-like patterns P1B are formed so as to correspond to the detection positions of the first, the second, and the third optical sensors (300*a*, 300*b*, and 300*c*), respectively.

In the configuration illustrated in FIG. 14, the image densities ID of the four yellow patch-like patterns P1Y that serve as density detection patterns of one type are detected by the four optical sensors 300, respectively, and an average value of the four detection results is calculated so as to obtain an image density ID of the yellow patch-like patterns P1Y. The same process is performed to obtain an image density ID of the patch-like patterns P1 in each of the other colors.

In addition, a yellow transversal band pattern P2Y that serves as a density detection pattern of the other type is formed in such a manner that this single pattern passes through the detection positions of the four optical sensors 300. Accordingly, the image density ID of the single yellow transversal band pattern P2Y is detected by the four optical sensors 300, and an average value of the four detection results is used as an image density ID of the yellow transversal band pattern P2Y during the correction control. The same process is performed to obtain an image density ID of the transversal band pattern P2 in each of the other colors.

By detecting the density detection patterns of the different types by using the plurality of sensors arranged along the main-scanning direction, it is possible to ensure that individual variations among the sensors and density unevenness in the main-scanning direction occurring in the image forming apparatus are reflected as little as possible in the detection results.

Even if the toner images are in the mutually-different colors, if the positions of the plurality of patch-like patterns P1 overlapped one another in the sub-scanning direction, it means that the plurality of patch-like patterns P1 would be present in a transfer nip (a primary transfer nip or a secondary transfer nip). In that situation, it would be impossible to appropriately detect the image densities ID of the patch-like patterns P1, because the transfer rate would be calculated as if an image having an image area ratio corresponding to the plurality of patch-like patterns P1 was transferred.

In contrast, in the configuration illustrated in FIG. 14, the four patch-like patterns P1 in each color are formed in such a manner that the positions thereof on the secondary transfer belt 9C do not overlap one another in the sub-scanning direction. With this arrangement, it is possible to appropriately detect the image densities ID of the patch-like patterns P1.

Because the image densities ID are configured to be detected by using the one or more optical sensors 300, the secondary transfer belt 9C configured to bear the toner images in the detection positions is required to have a certain level of glossiness.

To detect the level of glossiness, a handheld gloss meter (PG-1M manufactured by Nippon Denshoku Industries Co., Ltd.) is used. The level of glassiness is measured under the following conditions:

Measured item: The level of glossiness (mirror surface glossiness)

Measurement angle: 20°

Optical system: compliant with JIS Z8741; ISO 2813; ASTMD 523; and DIN 67530

Light source: a tungsten lamp

Detector: a photodiode

Measurement size: 20°, 10.0 mm×10.6 mm

When the measuring conditions above are used, the level of glossiness of the secondary transfer belt 9C that is valid for the detection of the image densities ID of the transfer current temporal correction patterns is 30 or higher.

When the secondary transfer belt 9C has a certain level of glossiness as described above, it is possible to improve the level of precision in the detection of the image densities ID of the transfer current temporal correction patterns performed by the one or more optical sensors 300.

Examples of the material for the belt having a certain level of glossiness and durability against long-term use include polyimide.

As for the level of glossiness, it is desirable to achieve a level of glossiness of 30 or higher under the glossiness measuring conditions described above, not only for the secondary transfer belt 9C in the third embodiment, but also for the intermediate transfer belt 2 in the first embodiment and the transfer belt 51 in the second embodiment.

Because the image forming apparatuses according to the first to the third embodiments are each a quadruple tandem image forming apparatus, the image formation units 66 have the toner corresponding to the four colors. Because the Q/M values and the toner concentrations vary among the different colors of toner, there is a possibility that the colors of images from a certain station may be less dense than the colors of images from the other stations. To cope with this situation, by forming the transfer current temporal correction patterns in each color, it is possible to ensure image stability while the color differences are taken into consideration.

The image forming apparatus according to any of the first to the third embodiments is configured to execute control so that the transfer bias is set to such a value that is able to diminish the difference in the transfer rates dependent on the image area ratios, when the difference in the transfer rates between an image having a high image area ratio and an image having a low image area ratio has become large due to the deterioration of the developer. More specifically, the image density difference ΔID is calculated as the difference in the transfer rates between the image having the high image area ratio and the image having the low image area ratio. Further, the control is executed so as to decrease the transfer bias correction amount if the image density difference ΔID is small and to increase the transfer bias correction amount if the image density difference ΔID is large. As for the control to correct the transfer bias, the control is executed so as to correct the primary transfer current value in the first and the second embodiments, whereas the execute is controlled so as to correct at least one of the primary transfer current value and the secondary transfer current value in the third embodiment.

The value of the transfer bias that is able to diminish the difference in the transfer rates dependent on the image area ratios falls in the range between a transfer bias exhibiting the highest transfer rate for the image having the high image area ratio and a transfer bias exhibiting the highest transfer rate for the image having the low image area ratio. Such a value of the transfer bias fluctuates depending on the degree of deterioration of the developer.

Accordingly, although detecting the degree of deterioration of the developer so as to set the transfer bias on the basis of the detection result may be considered, it is not possible to detect the degree of deterioration of the developer simply from the number of image formed sheets (the number of sheets printed) or the developer conveyance distance.

The inventors of the present disclosure have discovered the correlational relationship where, as the toner charge amount decreases while the deterioration of the developer progresses, the difference in the transfer rates between an image having a low image area ratio and an image having a high image area ratio becomes larger. On the basis of this correlational relationship, the inventors have discovered the relationship where the larger the image density difference ΔID is, the higher the degree of deterioration of the developer (the degree of decrease in the toner charge amount) is.

For this reason, during the temporal correction control in any of the first to the third embodiments, the correction amount for the transfer bias is arranged to be smaller, when the image density difference ΔID is smaller, i.e., when the degree of deterioration of the developer is lower. On the contrary, during the temporal correction control, the correction amount for the transfer bias is arranged to be larger, when the image density difference ΔID is larger, i.e., when the degree of deterioration of the developer is higher.

When the difference in the transfer rates between the image having the high image area ratio and the image having the low image area ratio has become larger due to the deterioration of the developer, it is possible to diminish the difference in the transfer rates dependent on the image area ratios by executing the temporal correction control in this manner.

The transfer current value of the transfer bias used for transferring the transfer current temporal correction patterns used for executing the temporal correction control is the initial optimal value for which the temporal correction amount is not taken into account. The setting value can be calculated as follows: "the setting value=the reference current value×an environment correction coefficient".

Japanese Patent Application Laid-open No. 2009-168906 describes an image forming apparatus configured to execute control so that, when a predetermined difference is detected in transfer outputs between an image having a high image area ratio and an image having a low image area ratio, the absolute value of a charging potential for the photoconductor is arranged to be lower than a standard value. Further, Japanese Patent Application Laid-open No. 2009-168906 also describes an image forming apparatus configured to execute control so that, when a predetermined difference is detected in the transfer outputs, the pressure applied between the members that abut against each other to form a transfer nip is lowered.

Japanese Patent Application Laid-open No. 2009-168906, however, does not describe a configuration in which the transfer bias value is controlled when the difference in the transfer rates between an image having a high image area ratio and an image having a low image area ratio has become larger.

The image forming apparatus according to any of the first to the third embodiments is configured to detect the difference in the transfer rates between the image having the high image area ratio and the image having the low image area ratio, while a focus is placed on the characteristic where the more the developer deteriorates, the larger the difference becomes in the transfer rates between the image having the high image area ratio and the image having the low image area ratio. Further, the image forming apparatus according to any of the first to the third embodiments is configured to diminish the difference in the transfer rates dependent on the image area ratios, by controlling the transfer bias value on the basis of the detected difference in the transfer rates, while a focus is placed on the characteristic where the transfer bias value that is able to diminish the difference in the transfer rates dependent on the image area ratios fluctuates depending on the degree of deterioration of the developer.

Although Japanese Patent Application Laid-open No. 2009-168906 describes controlling the charging potential or the applied pressure when the difference in the transfer rates between the image having the high image area ratio and the image having the low image area ratio has become larger, Japanese Patent Application Laid-open No. 2009-168906 does not describe in what situation the difference in the transfer rates becomes larger. Thus, Japanese Patent Application Laid-open No. 2009-168906 neither describes nor suggests the characteristic where the more the developer deteriorates, the larger the difference becomes in the transfer rates between the image having the high image area ratio and the image having the low image area ratio.

Further, Japanese Patent Application Laid-open No. 2009-168906 does not describe the characteristic, either, where the value of the transfer bias that is able to diminish the difference in the transfer rates dependent on the image area ratios falls in the range between a transfer bias exhibiting the highest transfer rate for the image having the high image area ratio and a transfer bias exhibiting the highest transfer rate for the image having the low image area ratio. Thus, Japanese Patent Application Laid-open No. 2009-168906 neither describes nor suggests the characteristic where the transfer bias value that is able to diminish the difference in the transfer rates dependent on the image area ratios fluctuates depending on the degree of deterioration of the developer.

As explained above, Japanese Patent Application Laid-open No. 2009-168906 neither describes nor suggests the focused important characteristics that led us to the configurations described in the first to the third embodiments. Consequently, on the basis of Japanese Patent Application Laid-open No. 2009-168906, it would not be easy to conceive of the configuration in which the transfer bias value is controlled when the difference in the transfer rates between the image having the high image area ratio and the image having the low image area ratio has become larger.

According to Japanese Patent Application Laid-open No. 2009-168906, the fluctuation in the impedance caused by the image area ratio in the main-scanning direction being high or low is diminished in a relative manner by raising the impedance of the entire photoconductor, by lowering the charging potential or lowering the pressure applied to the transfer nip. This arrangement is designed to diminish the fluctuation in the transfer rate dependent on the image area ratios in the main-scanning direction. It is designed to make the plotted lines for the patch image and for the solid image in the chart shown in FIG. 2 coincide with each other as much as possible. However, depending on the toner being used, it is impossible, in some situations, to make the plotted lines for the patch image and for the solid image in the chart shown in FIG. 2 substantially coincide with each other, even if control is executed to raise the impedance of the entire photoconductor when the developer has deteriorated.

When a developer includes deteriorated toner, "exhaustion" occurs. When a developer includes a carrier and toner, if the toner becomes more exhausted compared to the carrier, the action of the carrier to promote the toner to be electrically charged becomes degraded. Thus, it may become impossible to raise the toner charge amount (Q/M) to a level suitable for the developing process. Some types of toner can easily become exhausted, and if easily-exhausted toner is used in an image forming apparatus, it is impossible to make the plotted lines for the patch image and for the solid image in the chart shown in FIG. 2 substantially coincide with each other when the developer is in a deteriorated state. In that situation, even if control is executed, as described in Japanese Patent Application Laid-open No. 2009-168906, so as to raise the impedance of the entire photoconductor, it is not possible to diminish the fluctuation in the transfer rate caused by the difference in the image area ratios.

In contrast, when the image forming apparatus according to any of the first to the third embodiments is used, it is possible to set the transfer bias to a value that is able to diminish the difference in the transfer rates dependent on the image area ratios, even under a condition where the plotted lines for the patch image and for the solid image in the chart shown in FIG. 2 are different from each other and do not coincide.

Japanese Patent Application Laid-open No. 2011-209674 describes an image forming apparatus configured to control a transfer current value in accordance with image area ratios. The image forming apparatus described in Japanese Patent Application Laid-open No. 2011-209674 is configured to obtain an image area ratio of an image to be currently formed on the basis of image information acquired before the image formation and to execute control as necessary so as to realize a transfer current value suitable for the image area ratio of the image, in synchronization with the timing with which a transfer process is performed on the image. Although Japanese Patent Application Laid-open No. 2011-209674 describes the configuration in which the transfer current value is controlled, the configuration described in Japanese Patent Application Laid-open No. 2011-209674 is completely different from the configurations described in the first to the third embodiments of the present disclosure in which the transfer current value is set to such a value that is able to diminish the difference in the transfer rates dependent on the image area ratios and, once the transfer current value is set, transfer processes are performed by using the set transfer current value even when a transfer process is performed on an image having a different image area ratio.

The image forming apparatus of the present disclosure is similarly applicable not only to so-called tandem image forming apparatuses, but also to single-drum image forming apparatuses configured to sequentially form toner images in different colors on a single photoconductor drum and to obtain a color image by sequentially superimposing the toner images in the different colors on one another. The image forming apparatus does not necessarily have to be a multifunction peripheral combining a copying machine, a printer, and a facsimile. The image forming apparatus may be a stand-alone apparatus having any of these functions or may be a multi-function peripheral having other combinations of functions such as a multifunction peripheral combining a copying machine and a printer. Regardless of the type of the image forming apparatus, it is also acceptable to adopt the direct transfer method by which toner images in different colors are directly transferred onto a transfer member, without using any intermediate transfer member. In that situation, the toner images formed on the plurality of image bearers are directly transferred onto a sheet.

The advantageous effects described in the embodiments of the present invention are merely examples of the most preferable effects achieved by the present invention. Thus, the advantageous effects of the present invention are not limited to those described in the embodiments of the present invention.

The advantages effects described above are merely examples. The present invention is able to achieve specific advantageous effects from each of the different aspects described below:

Aspect A

An image forming apparatus such as the copying machine 1 includes: an image bearer such as the photoconductor 3 whose surface moves; a toner image forming unit such as the developing device 6 for forming a toner image on a surface of the image bearer by using a developer; and a transfer unit such as the primary transfer device for transferring the toner image formed on the surface of the image bearer onto a surface of a transfer member such as the intermediate transfer member 2 by applying a transfer bias thereto. The image forming apparatus includes a detector such as the optical sensor 300 for detecting an image density of the toner image formed on the surface of the transfer member. A plurality of types of density detection patterns such as the patch-like pattern P1 and the transversal band pattern P2 are formed on the surface of the image bearer in mutually-different positions in a surface-movement direction thereof, the plurality of types of density detection patterns having mutually-different lengths in a direction orthogonal to the surface-movement direction of the image bearer. The plurality of types of density detection patterns are transferred onto the surface of the transfer member by the transfer unit. An image density difference such as the image density difference ΔID between the plurality of types of density detection patterns is calculated on the basis of a detection result obtained by the detector by detecting image densities of the plurality of types of density detection patterns transferred on the surface of the transfer member, and the transfer bias is corrected on the basis of a value of the image density difference.

With this arrangement, as explained in the first embodiment, it is possible to find out the degree of deterioration of the developer more appropriately by calculating the image density difference. It is therefore possible to set the transfer bias to a value corresponding to the degree of deterioration of the developer and to inhibit degradation of the image quality. The reasons can be explained as follows: The relationship between the transfer bias and the transfer rate of the toner image transferred from the image bearer to the transfer member has a tendency where, if the transfer bias is raised while the image area ratio is constant, the transfer rate also increases, but the transfer rate starts decreasing after the transfer bias value reaches a certain value. The inventors of the present disclosure has discovered that a transfer bias value exhibiting the highest transfer rate for an image having a high image area ratio (e.g., a completely-solid image) is smaller than that for an image having a low image area ratio (e.g., a patch image). For this reason, if the transfer bias is set to a value that makes the transfer rate of the image having the low image area ratio the highest, when an image having a high image area ratio is output, the transfer rate becomes low, and also, the image density of the output image becomes low, too. When the transfer rate fluctuates depending on the image area ratios, the image densities will be uneven. Thus, it is required to set the transfer bias to such a value that is able to diminish the fluctuation in the transfer rate caused by the difference in the image area ratios. To make a setting according to this requirement, the transfer bias is set to such a value that is able to diminish the difference in the transfer rates dependent on the image area ratios, so as to fall in the range between a transfer bias exhibiting the highest transfer rate for the image having the high image area ratio and a transfer bias value exhibiting the highest transfer rate for the image having the low image area ratio. With this arrangement, it is possible to diminish the fluctuation in the transfer rate caused by the difference in the image area ratios.

In this situation, while a developer at an initial period of use and has not yet deteriorated is being used, the transfer bias that is able to diminish the difference in the transfer rates between the image having the high image area ratio and the image having the low image area ratio is referred to as the "initial transfer bias". The image area ratio is a percentage of the area in which an image is actually formed, with respect to the entire area of a certain region. For example, the image area ratio is calculated as a ratio of the number of dots forming an image to the number of dots in the entire area of a certain region. Further, the transfer nip at which the toner image is transferred from the image bearer to the transfer member is an area that has a shorter length in the sub-scanning direction parallel to the surface movement direction of the image bearer or the transfer member and that has a longer length the main-scanning direction orthogonal to the sub-scanning direction. For this reason, there is a tendency where, when an image longitudinal in the main-scanning direction, which is orthogonal to the surface movement direction of the image bearer, passes through the transfer nip, the image area ratio at the transfer nip becomes higher.

Diligent studies of the inventors of the present disclosure have revealed that, when a developer has deteriorated due to use over the course of time, the transfer bias value exhibiting the highest transfer rate is impacted less for an image having a low image area ratio and is impacted more for an image having a high image area ratio. More specifically, when the developer has deteriorated due to use over the course of time, the transfer bias value exhibiting the highest transfer rate shifts toward the smaller value side with a larger shift width for the image having the high image area ratio. Further, when a transfer process is performed under the initial transfer bias condition while using a deteriorated developer, it has been learned that the higher the image area ratio is, the higher the decreasing ratio of the transfer rate is. Accordingly, as the deterioration of the developer progresses, the difference in the transfer rates between the image having the high image area ratio and the image having the low image area ratio becomes larger, if a transfer process is performed under the initial transfer bias condition. Thus, by calculating the difference in the transfer rates, it is possible to find out the degree of deterioration of the developer more appropriately. Further, the difference in the transfer rates can be observed as a difference in the image densities on the transfer member. It is possible to set the transfer bias to a value corresponding to the degree of deterioration of the developer, by finding out the degree of deterioration of the developer more appropriately and correcting the transfer bias on the basis of the obtained result. It is therefore possible to inhibit degradation of the image quality. Consequently, according to this aspect, it is possible to find out the degree of deterioration of the developer more appropriately, by calculating the image density difference. It is therefore possible to set the transfer bias to the value corresponding to the degree of deterioration of the developer and to inhibit degradation of the image quality.

Aspect B

In Aspect A, as for the timing with which control such as the transfer current temporal correction control is executed so as to form the density detection patterns, frequency with which the control is executed is higher during an initial period at a start of use, whereas the frequency with which the control is executed is lowered over a course of time.

With this arrangement, as explained in the first embodiment, it is possible to correct the transfer current more efficiently. The reasons can be explained as follows: Generally speaking, the toner charge amount (Q/M) decreases over the course of time, and the decreasing ratio is especially high in the initial period at the start of the use, and the decreasing ratio gradually becomes lower. For this reason, it is possible to execute the control while efficiently following the decrease in the toner charge amount (Q/M), by performing the pattern detection process for finding out the degree of deterioration of the developer a larger number of times during the initial period (up to approximately 10K sheets) and gradually decreasing the number of times the detection process is performed over the course of time. With this arrangement, it is possible to reduce stand-by periods for the user and suppress toner consumption amounts.

Aspect C

In Aspect A or B, the density detection patterns are formed when image quality adjustment control is executed so as to detect an image density of a density adjustment pattern image formed on the image bearer and transferred onto the transfer member and to determine an image formation condition on a basis of a detection result.

With this arrangement, as explained in the first embodiment, it is possible to collectively execute the different types of control that may cause waiting periods for the users. It is therefore possible to reduce the frequency with which waiting periods are caused for the users.

Aspect D

In any one of Aspects A to C, the density detection patterns are formed between sheets of paper, such as between sheets of transfer paper.

With this arrangement, as explained in the first embodiment, it is possible to execute optimal control while better following the degree of deterioration of the developer, by forming the density detection patterns, not only when the image quality adjustment control is executed, but also in the position between the sheets of paper.

Aspect E

In any one of Aspects A to D, the transfer bias is corrected in such a manner that the larger the value of the image density difference is, the smaller a value of the transfer bias is.

With this arrangement, as explained in the first embodiment, it is possible to set the transfer bias to a value that is able to diminish the difference in the transfer rates dependent on the image area ratios; so as to become smaller in accordance with the degree of deterioration of the developer. Consequently, even if the developer is in a deteriorated state from the temporal deterioration, it is possible to diminish the fluctuation in the transfer rate caused by the difference in the image area ratios, and it is therefore possible to inhibit degradation of the image quality.

Aspect F

In any one of Aspects A to E, an upper limit is set for a correction amount by which the transfer bias is corrected.

With this arrangement, as explained in the first embodiment, it is possible to prevent side effects (e.g., a scattered transfer) caused by lowering the transfer bias excessively.

Aspect G

In any one of Aspects A to F, when the density detection patterns are formed by using black toner such as the toner for black, the density detection patterns are each formed by using a half-tone image, instead of a solid image.

With this arrangement, as explained in the first embodiment, it is possible to correct the transfer current more appropriately by detecting the image densities with a higher level of precision and calculating the image density difference. The reasons can be explained as follows: Black toner has characteristics where the light with which the toner is irradiated is absorbed at the surface of the toner, and it is therefore not possible to achieve sensitivity for diffuse reflection light. Thus, for the black toner, the toner adhesion amount is detected by using only regular reflection light. Further, when the adhesion amount is detected by using only the regular reflection light, the sensitivity decreases as the toner adhesion amount increases. Thus, the detection range for the adhesion amount for the black toner is narrower than that for the toner in the other colors where the adhesion is detected by using both diffuse reflection light and regular reflection light. Accordingly, the patterns are formed with such a developing bias that makes the adhesion amounts of the toner patches in black smaller than the toner adhesion amount for a solid density. With this arrangement, it is possible to detect the adhesion amounts with an excellent level of precision and to detect the image densities with a higher level of precision.

Aspect H

An image forming apparatus such as the printer 61 includes: an image bearer such as the photoconductor 3 whose surface moves; a toner image forming unit such as the developing device 6 for forming a toner image on a surface of the image bearer by using a developer; a recording medium conveying member such as the transfer belt 51 whose surface moves while holding a recording medium such as the recording paper S thereon and that conveys the recording medium to an opposing position (such as the transfer part) opposite to the image bearer; and a transfer unit such as the bias rollers 59 for transferring the toner image formed on the surface of the image bearer onto a surface of the recording medium, by applying a transfer bias to the opposing position of the image bearer and the recording medium conveying member. The image forming apparatus includes a detector such as the optical sensor 300 for detecting an image density of the toner image formed on a surface of the recording medium conveying member. A plurality of types of density detection patterns such as the patch-like pattern P1 and the transversal band pattern P2 are formed on the surface of the image bearer in mutually-different positions in a surface-movement direction thereof, the plurality of types of density detection patterns having mutually-different lengths in a direction orthogonal to the surface-movement direction of the image bearer. The plurality of types of density detection patterns are transferred onto the surface of the recording medium conveying member by the transfer unit. An image density difference such as the image density difference ΔID between the plurality of types of density detection patterns is calculated on a basis of a detection result obtained by the detector by detecting image densities of the plurality of types of density detection patterns transferred on the surface of the recording medium conveying member, and the transfer bias is corrected on a basis of a value of the image density difference.

With this arrangement, as explained in the second embodiment, for the same reasons as explained for Aspect A, it is possible to find out the degree of deterioration of the developer more appropriately by calculating the image density difference. It is therefore possible to set the transfer bias to a value corresponding to the degree of deterioration of the developer. Consequently, it is possible to inhibit degradation of the image quality.

Aspect I

An image forming apparatus such as the copying machine 1 includes: an image bearer such as the photoconductor 3 whose surface moves; a toner image forming unit such as the developing device 6 for forming a toner image on a surface of the image bearer by using a developer; a transfer unit such as the primary transfer device for transferring the toner image formed on the surface of the image bearer onto a surface of an intermediate transfer member such as the intermediate transfer belt 2, by applying a transfer bias thereto; and a recording medium transfer unit such as the secondary transfer device 9 for transferring the toner image on the surface of the intermediate transfer member onto a recording medium such as the recording paper at a recording medium transfer part such as the secondary transfer part, by applying a recording medium transfer bias such as the secondary transfer bias thereto; and a recording medium conveying member such as the secondary transfer belt 9C that is positioned opposite to the intermediate transfer member at the recording medium transfer part while the recording medium is interposed therebetween and that is configured to convey the recording medium by holding the recording medium on a surface thereof whose surface moves. The image forming apparatus includes a detector such as the optical sensor 300 for detecting an image density of the toner image formed on the surface of the recording medium conveying member. A plurality of types of density detection patterns such as the patch-like pattern P1 and the transversal band pattern P2 are formed on the surface of the image bearer in mutually-different positions in a surface-movement direction thereof, the plurality of types of density detection patterns having mutually-different lengths in a direction orthogonal to the surface-movement direction of the image bearer. The plurality of types of density detection patterns are transferred onto the surface of the intermediate transfer member by the transfer unit. The plurality of types of density detection patterns transferred on the surface of the intermediate transfer member are transferred onto the surface of the recording medium conveying member by the recording medium transfer unit. An image density difference such as the image density difference ΔID between the plurality of types of density detection patterns is calculated on a basis of a detection result obtained by the detector by detecting image densities of the plurality of types of density detection patterns transferred on the surface of the recording medium conveying member, and the transfer bias is corrected on a basis of a value of the image density difference.

With this arrangement, as explained in the third embodiment, for the same reasons as explained for Aspect A, it is possible to find out the degree of deterioration of the developer more appropriately by calculating the image density difference. It is therefore possible to set the transfer bias to a value corresponding to the degree of deterioration of the developer. Consequently, it is possible to inhibit degradation of the image quality.

Further, because the image forming apparatus is configured so as to detect the image densities of the density detection patterns formed on the surface of the recording medium conveying member, it is possible to employ, as the intermediate transfer member, one that has no glossiness on the surface thereof. The flexibility in selecting the material for the intermediate transfer member is therefore improved. Further, because the image densities of the density detection patterns transferred from the intermediate transfer member to the recording medium conveying member are detected, it is possible to perform the detection in a position close to that of a final image, and it is therefore possible to improve the image stability.

Aspect J

In Aspect H or I, the level of glossiness of the surface of the recording medium conveying member such as the secondary transfer belt 9C is 30 or higher.

With this arrangement, as explained in the third embodiment, it is possible to improve the level of precision in the detection process of optically detecting the image densities of the plurality of types of density detection patterns such as the patch-like pattern P1 and the transversal band pattern P2.

Aspect K

In any one of Aspects H to J, a correction process is performed in such a manner that the larger the value of the image density difference such as the image density difference ΔID is, the smaller a value of at least one of the transfer bias such as the primary transfer current value and the recording medium transfer bias such as the secondary transfer current value is.

With this arrangement, as explained in the third embodiment, it is possible to set either the transfer bias or the recording medium transfer bias to a value that is able to diminish the difference in the transfer rates dependent on the image area ratios, so as to become smaller in accordance with the degree of deterioration of the developer. Consequently, even if the developer is in a deteriorated state from the temporal deterioration, it is possible to diminish the fluctuation in the transfer rate caused by the difference in the image area ratios, and it is therefore possible to inhibit degradation of the image quality.

Aspect L

In any one of Aspects A to K, either the transfer member such as the intermediate transfer belt 2 or the recording medium conveying member such as the transfer belt 51 or the secondary transfer belt 9C has a belt-like shape.

With this arrangement, as explained in the third embodiment, it is possible to improve the flexibility in designing the layout, and it is therefore possible to further improve the level of precision in the detection process.

Aspect M

In any one of Aspects A to L, the image forming apparatus includes a plurality of image bearers such as the photoconductors 3 and a plurality of toner image forming units such as the developing devices 6. The plurality of types of density detection patterns such as the patch-like patterns P1 and, the transversal band patterns P2 are formed on each of the plurality of image bearers.

With this arrangement, as explained in the third embodiment, by forming the transfer current temporal correction patterns in each color, it is possible to ensure image stability while the color differences are taken into consideration.

Aspect N

In any one of Aspects A to L, the detector such as the optical sensor 300 has detecting positions along a direction orthogonal to a surface-movement direction of either the transfer member such as the intermediate transfer belt 2 or the recording medium conveying member such as the transfer belt 51 or the secondary transfer belt PC, and each of the plurality of types of density detection patterns such as the patch-like patterns P1 and the transversal band patterns P2 is detected in the detection positions, so that an average value of detection results is calculated.

With this arrangement, as explained in the third embodiment with reference to FIG. 14, by calculating the average value of the detection results from the plurality of locations, it is possible to ensure that individual variations among the detector and density unevenness in the main-scanning direction occurring in the image forming apparatus are reflected as little as possible in the detection results.

At least one aspect of the present invention achieves an advantageous effect where it is possible to find out the degree of deterioration of the developer more appropriately and to set the transfer bias to an appropriate value.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. An image forming apparatus comprising:

an image bearer whose surface moves;

a toner image forming unit that forms a toner image on the surface of the image bearer by using a developer;

a transfer unit that transfers the toner image formed on the surface of the image bearer onto a surface of a transfer member by applying a transfer bias thereto;

a detector that detects an image density of the toner image formed on the surface of the transfer member; and a controller that controls the transfer bias, wherein the toner image forming unit forms a plurality of types of density detection patterns on the surface of the image bearer in mutually-different positions in a surface-movement direction of the image bearer, the plurality of types of density detection patterns having mutually-different lengths in a direction orthogonal to the surface-movement direction of the image bearer, the transfer unit transfers the plurality of types of density detection patterns onto the surface of the transfer member without varying the transfer current, the detector detects image densities of the plurality of types of density detection patterns transferred on the surface of the transfer member, and the controller calculates an image density difference between the plurality of types of density detection patterns on a basis of a detection result obtained by the detector, and corrects the transfer bias on a basis of a value of the image density difference.

2. The image forming apparatus according to claim 1, wherein frequency of the formation of the density detection patterns is set in such a manner that the frequency is higher during an initial period at a start of use of the developer, and the frequency is lowered over a course of time.

3. The image forming apparatus according to claim 1, wherein the image forming unit forms the density detection patterns at a time of execution of image quality adjustment control for determining an image forming condition.

4. The image forming apparatus according to claim 1, wherein the density detection patterns are formed between sheets of paper on the image bearer.

5. The image forming apparatus according to claim 1, wherein the controller corrects the transfer bias in such a manner that the larger the value of the image density difference is, the smaller a value of the transfer bias is.

6. The image forming apparatus according to claim 1, wherein the controller has an upper limit of a correction amount of the transfer bias.

7. The image forming apparatus according to claim 1, wherein when the toner image forming unit forms the density detection patterns by using black toner, the toner image forming unit forms a half-tone image of each of the density detection patterns, instead of a solid image.

8. The image forming apparatus according to claim 1, wherein the transfer member has a belt-like shape.

9. The image forming apparatus according to claim 1, wherein the image bearer is provided in plural, the toner image forming unit is provided in plural, and the toner image forming units form the plurality of types of density detection patterns on each of the plurality of image bearers.

10. The image forming apparatus according to claim 1, wherein the detector has a plurality of detecting positions along a direction orthogonal to a surface-movement direction of the transfer member, and detects each of the plurality of types of density detection patterns at the detection positions, and the controller calculates an average value of detection results obtained by the detector.

11. An image forming apparatus comprising:

an image bearer whose surface moves;

a toner image forming unit that forms a toner image on the surface of the image bearer by using a developer;

a recording medium conveying member whose surface moves while holding a recording medium thereon and which conveys the recording medium to an opposing position opposite to the image bearer;

a transfer unit that transfers the toner image formed on the surface of the image bearer onto a surface of the recording medium by applying a transfer bias to the opposing position of the image bearer and the recording medium conveying member;

a detector that detects an image density of the toner image formed on the surface of the recording medium conveying member; and a controller that controls the transfer bias, wherein the toner image forming unit forms a plurality of types of density detection patterns on the surface of the image bearer in mutually-different positions in a surface-movement direction of the image bearer, the plurality of types of density detection patterns having mutually-different lengths in a direction orthogonal to the surface-movement direction of the image bearer, the transfer unit transfers the plurality of types of density detection patterns onto the surface of the recording medium conveying member without varying the transfer current, the detector detects image densities of the plurality of types of density detection patterns transferred on the surface of the recording medium conveying member, and the controller calculates an image density difference between the plurality of types of density detection patterns on a basis of a detection result obtained by the detector, and corrects the transfer bias on a basis of a value of the image density difference.

12. The image forming apparatus according to claim 11, wherein the controller corrects the transfer bias in such a manner that the larger the value of the image density difference is, the smaller a value of the transfer bias is.

13. The image forming apparatus according to claim 11, wherein the detector has a plurality of detecting positions along a direction orthogonal to a surface-movement direction of the transfer member, and detects each of the plurality of types of density detection patterns at the detection positions, and the controller calculates an average value of detection results obtained by the detector.

14. An image forming apparatus comprising:

an image bearer whose surface moves;

a toner image forming unit that forms a toner image on the surface of the image bearer by using a developer;

a transfer unit that transfers the toner image formed on the surface of the image bearer onto a surface of an intermediate transfer member by applying a transfer bias thereto;

a recording medium transfer unit that transfers the toner image transferred on the surface of the intermediate transfer member onto a recording medium at a recording medium transfer position, by applying a recording medium transfer bias thereto; and a recording medium conveying member that is positioned opposite to the intermediate transfer member at the recording medium transfer position while the recording medium is interposed therebetween and that conveys the recording medium by holding the recording medium on a surface thereof whose surface moves;

a detector that detects an image density of the toner image formed on the surface of the recording medium conveying member; and a controller that controls the recording medium transfer bias, wherein the toner image forming unit forms a plurality of types of density detection patterns on the surface of the image bearer in mutually-different positions in a surface-movement direction of the image bearer, the plurality of types of density detection patterns having mutually-different lengths in a direction orthogonal to the surface-movement direction of the image bearer, the transfer unit transfers the plurality of types of density detection patterns onto the surface of the intermediate transfer member without varying the transfer current, the recording medium transfer unit transfers the plurality of types of density detection patterns transferred on the surface of the intermediate transfer member onto the surface of the recording medium conveying member, the detector detects image densities of the plurality of types of density detection patterns transferred on the surface of the recording medium conveying member, and the controller calculates an image density difference between the plurality of types of density detection patterns on a basis of a detection result obtained by the detector, and corrects the recording medium transfer bias on a basis of a value of the image density difference.

15. The image forming apparatus according to claim 14, wherein the controller corrects the recording medium transfer bias in such a manner that the larger the value of the image density difference is, the smaller a value of the recording medium transfer bias is.

16. The image forming apparatus according to claim 14, wherein the recording medium conveying member has a belt-like shape.

17. The image forming apparatus according to claim 14, wherein the image bearer is provided in plural, the toner image forming unit is provided in plural, and the toner image forming units form the plurality of types of density detection patterns on each of the plurality of image bearers.

18. The image forming apparatus according to claim 14, wherein the detector has a plurality of detecting positions along a direction orthogonal to a surface-movement direction of the recording medium conveying member, and detects each of the plurality of types of density detection patterns at the detection positions, and the controller calculates an average value of detection results obtained by the detector.

* * * * *